US008459704B2

(12) United States Patent
Daniels et al.

(10) Patent No.: US 8,459,704 B2
(45) Date of Patent: Jun. 11, 2013

(54) SECURITY SYSTEM FOR ENTRANCE BARRIERS

(75) Inventors: Ron R. Daniels, Houston, TX (US); Sheila M. Daniels, Houston, TX (US); Ronald O. Browne, Houston, TX (US)

(73) Assignee: Ron R. Daniels, Houston, TX (US)

( * ) Notice: Subject to any disclaimer, the term of this patent is extended or adjusted under 35 U.S.C. 154(b) by 0 days.

(21) Appl. No.: 11/428,305

(22) Filed: Jun. 30, 2006

(65) Prior Publication Data

US 2007/0000293 A1 Jan. 4, 2007

Related U.S. Application Data

(60) Provisional application No. 60/696,075, filed on Jul. 1, 2005.

(51) Int. Cl.
*E05C 1/02* (2006.01)

(52) U.S. Cl.
USPC ..... 292/137; 292/259 R; 292/292; 292/289; 292/338

(58) Field of Classification Search
USPC ..... 292/137, 259 R, 289, 292, 295, 338, 292/339, 1; 70/14, 18
See application file for complete search history.

(56) References Cited

U.S. PATENT DOCUMENTS 2,163,206 A 6/1939 Lopez
2,421,275 A 5/1947 Lopez
3,792,885 A * 2/1974 Giardina et al. ..... 292/39
3,986,741 A * 10/1976 Giovannini ..... 292/268
4,288,944 A * 9/1981 Donovan ..... 49/395
4,462,625 A * 7/1984 Barnhill ..... 292/259 R
4,606,566 A 8/1986 Bott
4,779,910 A * 10/1988 Dameron ..... 292/259 R
5,447,046 A * 9/1995 Duffus ..... 70/101

(Continued)

FOREIGN PATENT DOCUMENTS

EP 0 341 529 A2 4/1989
EP 0 724 058 A1 7/1996

(Continued)

OTHER PUBLICATIONS

International Search Report for Corresponding International Patent Application No. PCT/US2006/026449.

(Continued)

*Primary Examiner* — Carlos Lugo
*Assistant Examiner* — Mark Williams
(74) *Attorney, Agent, or Firm* — Sutton McAughan Deaver PLLC

(57) ABSTRACT

An improved security system to prevent unwanted entrance through a hinged barrier, such as, but not limited to a door, is provided and comprises a member associated with the barrier, whether internal or eternal to the barrier, and adapted to extend from a first length to a second length. An actuation mechanism is coupled to the member and is adapted to extend the member from the first length to the second length and to contract the member from the second length to the first length. A receptacle is provided adjacent the barrier for receiving a portion of the member when the member is extended by the actuating mechanism. A hinge assembly is provided and is disposed substantially opposite the receptacle and adjacent the barrier and is coupled to another end of the member, such that when the member is actuated to the extended position, the member, receptacle and hinge assembly form a security system to prevent unwanted entrance through the barrier.

16 Claims, 27 Drawing Sheets

U.S. PATENT DOCUMENTS

| | | | | |
|---|---|---|---|---|
| 5,984,387 | A * | 11/1999 | Zeller | 292/296 |
| 6,481,252 | B2 | 11/2002 | Calle et al. | |
| 2002/0007655 | A1 | 1/2002 | Calle et al. | |
| 2002/0178771 | A1 | 12/2002 | Porter | |
| 2003/0067176 | A1 | 4/2003 | Stevens et al. | |

FOREIGN PATENT DOCUMENTS

| | | | |
|---|---|---|---|
| FR | 2781245 | A | 1/2006 |
| GB | 590 723 | | 7/1947 |
| GB | 637 149 | | 5/1950 |
| GB | 2 171 751 | A | 9/1986 |

OTHER PUBLICATIONS

Written Opinion for Corresponding International Patent Application No. PCT/US2006/026449.

* cited by examiner

SECURITY SYSTEM FOR ENTRANCE BARRIERS

CROSS REFERENCE TO RELATED APPLICATIONS

This application claims benefit of and priority to U.S. Provisional Application Ser. No. 60/696,075 filed on Jul. 1, 2005.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field Of The Invention. This disclosure relates generally to a security system for entrance barriers, and more particularly to an improved security system to prevent unwanted ingress through a door-like structure.

DESCRIPTION OF THE RELATED ART.

U.S. Pat. No. 6,481,252 issued on Nov. 19, 2002 and disclosed a security locking system that includes a cross bar pivotally connected at one end in a manner to pivot in two planes, a locking brace connected to a door frame at an opposite point from the point of the pivoting connection of the cross bar in a locking brace which includes an actuating mechanism which rotates around the locking bar and pulls the locking bar into a U-shaped sleeve. In an alternative embodiment, a segmented cross-bar is located totally within the door and is lengthened or shortened by rotation of a key on the outside of the door to enter or exit a pair of receptacles in the door frames to lock the door, or to open the door, respectively This application for patent discloses an improved security system to prevent unwanted ingress through an entrance barrier, such as, but not limited to, a door-like structure.

BRIEF SUMMARY OF THE INVENTION

It is an object of the present invention to provide a security system to prevent unwanted entrance through a hinged barrier, such as, but not limited to a door, which system comprises a member associated with the barrier, whether internal or external to the barrier, and adapted to extend from a first length to a second length. An actuating mechanism is coupled to the member and is adapted to extend the member from the first length to the second length and to contract the member from the second length to the first length. A receptacle is provided adjacent the barrier for receiving a portion of the member when the member is extended by the actuating mechanism. A hinge assembly is provided and is disposed substantially opposite the receptacle and adjacent the barrier and is coupled to another end of the member, such that when the member is actuated to the extended position, the member, receptacle and hinge assembly form a security system to prevent unwanted entrance through the barrier.

While the inventions disclosed herein are susceptible to various modifications and alternative forms, only a few specific embodiments have been shown by way of example in the figures and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art.

DETAILED DESCRIPTION

One or more illustrative embodiments incorporating the invention disclosed herein are presented below. Not all features of an actual implementation are described or shown in this application for the sake of clarity. It is understood that the development of an actual embodiment incorporating the present invention, numerous implementation-specific decisions must be made to achieve the developer's goals, such as compliance with system-related, business-related, government-related and other constraints, which vary by implementation and from time to time. While a developer's efforts might be complex and time-consuming, such efforts would be, nevertheless, a routine undertaking for those of ordinary skill in the art having benefit of this disclosure.

In general terms, Applicants have created an improved security system that may be used in conjunction with or as a replacement for a conventional deadbolt lock system. For example, Applicants have created an improved security system for an entrance barrier, such as, but not limited to a door or door-like structure, comprising a security member that preferably spans the width of the door, a hinge mechanism coupled to the security member at one end, an actuating mechanism for moving the security member into locked and unlocked configurations and a lock receptacle for engaging the security member in the locked condition. In addition, the improved security system may comprise an override mechanism to prevent the security member from disengaging from its locked condition and/or additional security features, such as keyed access, card reader, push button coded locks, fingerprint reader and other biometric devices. The specific embodiments discussed below are illustrated as disposed on the outside surface for clarity of discussion. It will be appreciated that the improved security system or portions of the system, such as, but not limited to, the security member may be, and preferably are, internal to the barrier.

Figure 1:
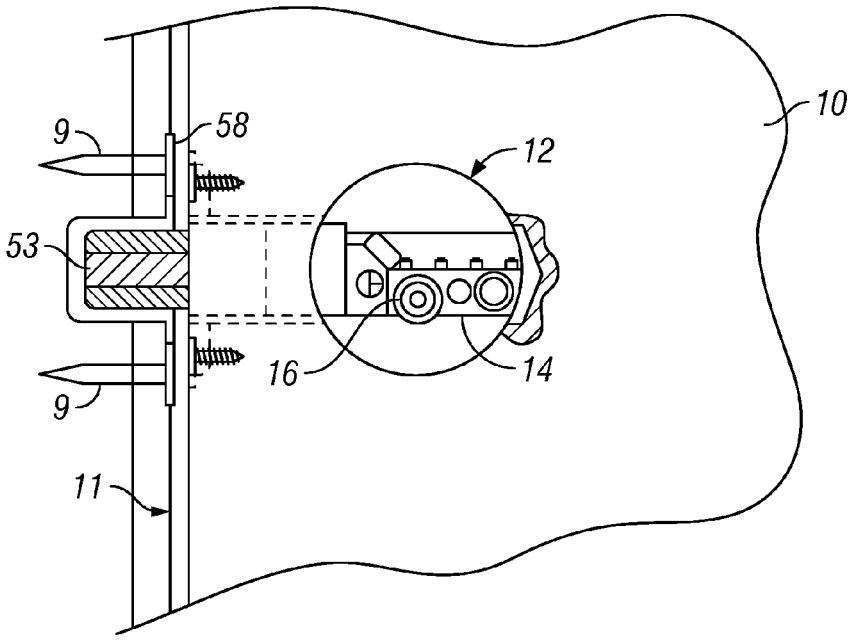
FIG. 1 (Prior Art)
FIG. 1 illustrates a conventional deadbolt lock installation in an entrance door.

FIG. 1 illustrates a conventional deadbolt locking system 14 that may be used to prevent unwanted ingress into an area. Typically, a hardened cylinder 53 is extended about one inch in distance through a striker plate 58 and into a recessed pocket formed in jamb 11. The striker plate 58 is usually held flush or in a shallow recess in the jamb 11 with one or more fasteners 9, such as two short wood screws. Typically, deadbolt locks 14 of the type illustrated in FIG. 1 restrict movement of the barrier 10 in a plane normal to the throw of the cylinder 53. Thus, the hardened cylinder 53 reacts against the striker plate 58 and the jamb 11 to resist unwanted ingress. It will be appreciated that for numerous installations of dead bolt 14, such as in residences, the jamb 11 is oftentimes weaker in strength than the hardened cylinder 53. The barrier 10 is vulnerable to breach if sufficient force is applied, such as by a powerful kick or battering ram, so that the jamb 11, which is often times made out of wood, is ruptured, carrying the striker plate and screws with it.

Figure 2:
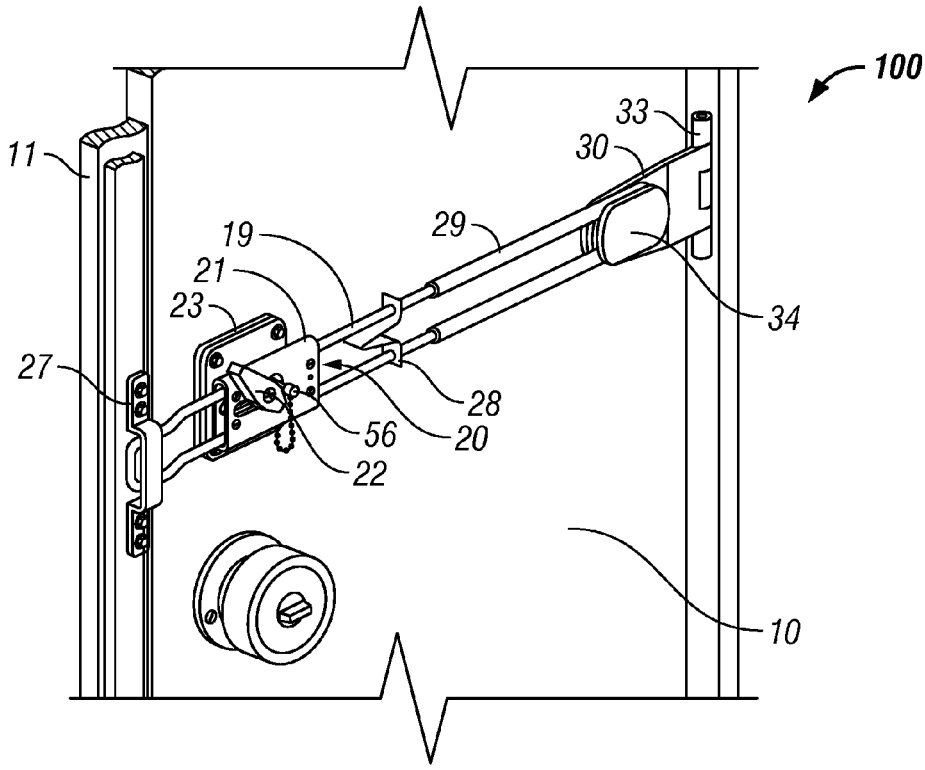
FIG. 2 illustrates an embodiment of an improved security system comprising a partially pivoting and telescoping bar and tube structure between two parallel doorframes.

FIG. 2 illustrates a first embodiment of an improved security locking system 100 according to the present invention. It can be seen that the improved system 100 comprises elements that traverse the width of the barrier 10, in contrast to the conventional deadbolt 14 described above. Telescoping member 19 is capable of extending from or contracting into member 29 so as to fit all widths of barriers 10, such as standard door widths which are generally 24" to 36" wide. One end of the tubular member 29 may be affixed to a hinge portion 30 associated with the barrier 10. An actuating mechanism 20 causes the telescoping member 19 to extend or retract into tubular member 29 as desired. Activation of the mechanism 20, such as by rotating handle 22 causes the member 19 to shift about 1" distance, sufficient to engage clasp 27 positively so the door is secured and cannot swing open. The actuating mechanism 20 may or may not be associated with a conventional dead bolt lock 14. When the improved security system 100 is associated with a conventional dead bolt 14, the keyed portion of the dead bolt 14 typically will be located on the exterior of the barrier 10 and the actuating mechanism 20 will be located on the secured side of the barrier 10. Spacers 23 may be installed with the mechanism 20 as required to position the member 19 to enter clasp 27 effortlessly. FIG. 2 also illustrates alternative override mechanisms 26 and 28 that prevent the security system 100 from being unlocked unless the override is defeated. For example, if the security system 100 is associated with a conventional deadbolt lock that permits keyed access from outside the secured area, such keyed access will be prevented when the override mechanism 26 or 28 is activated.

Figure 3:
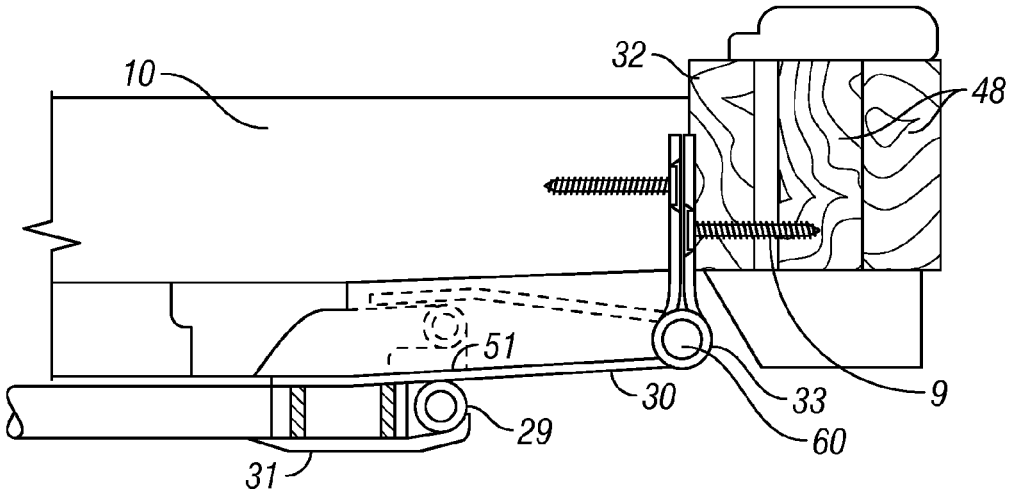
FIG. 3 illustrates a cross-section of a hinge assembly suitable for use with the improved security system.

FIG. 3 is a sectional view through the hinge portion 30 and capture plug 31 at the non-locking hinge end of the improved security system 100 illustrated in FIG. 2. In a preferred embodiment, the existing door hinge (not shown) is removed and the hinge 30 is installed in the existing hinge recess in the stationary jamb 32. Fasteners 9, such as screws, are preferably used to replace the standard hinge screws and are of a length sufficient to engage the studs 48 or other load bearing structures in the wall. It is preferred that hinge pin 60 (FIG. 4) is aligned with the other existing door hinge pins above and below it to avoid stressing the lock system components. It is preferred that hinge 30 be reversible such that it can be installed with its mating ears 33 facing either way (shown by dashed lines) so as to accommodate various projections that may exist on the door 10 surface, such as decoration or window trim. A score or notch 51 maybe preferably located on one side of the hinge 30 to allow the installer to bend the hinge 30 to make minute adjustments of the space between the door surface and the hinge surface, thereby setting the lock system essentially parallel to the door surface, as shown in FIG. 3.

Figure 4:
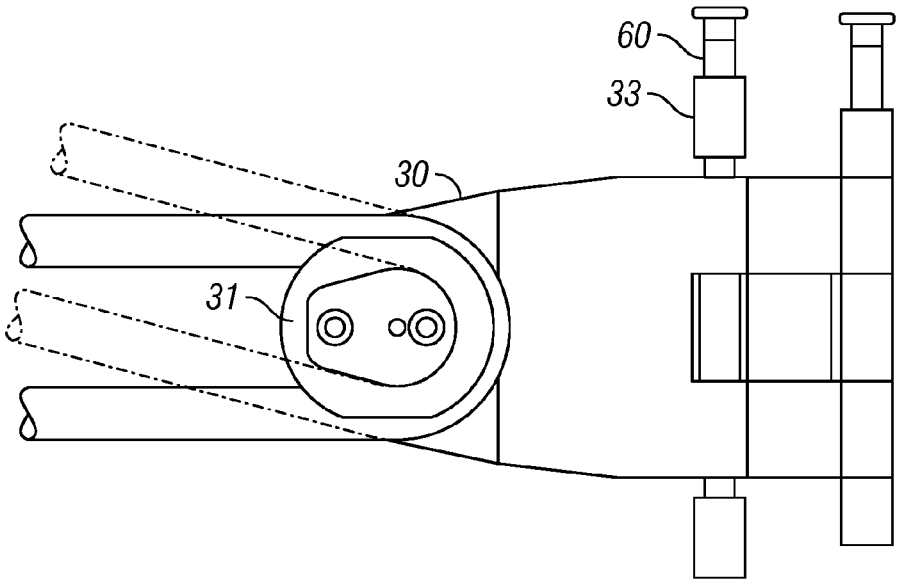
FIG. 4 illustrates another view of the hinge assembly depicted in FIG. 3.

FIG. 4 illustrates a capture plug 31, which may be incorporated into hinge plate 30. The plug 31 has a partial rearward located lip that traps the bent end of the member 29 (see also FIG. 3) and only allows limited rotation about the center axis of the capture plug 31 of about ±20° from the horizontal position. The capture plug 31 thereby permits the system 100 to utilize an existing middle hinge 30 position that is not necessarily in line horizontally with the existing deadbolt 14 location at the opening side of the door.

Figure 5A:
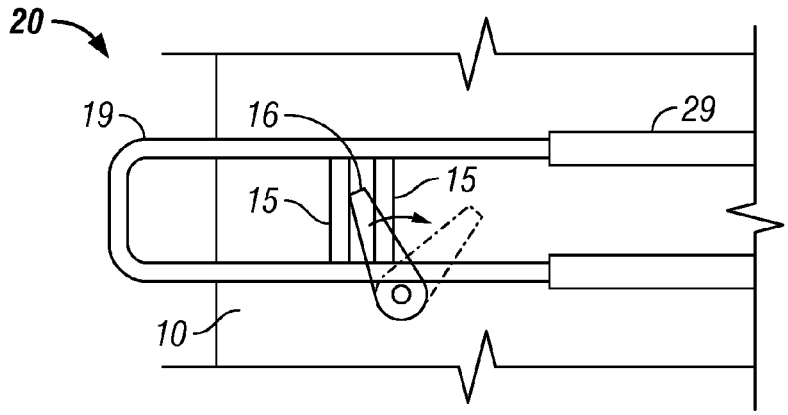
FIGS. 5*a-c* illustrate alternate embodiments of actuating mechanisms suitable for use with the improved security system.
Figure 5B:
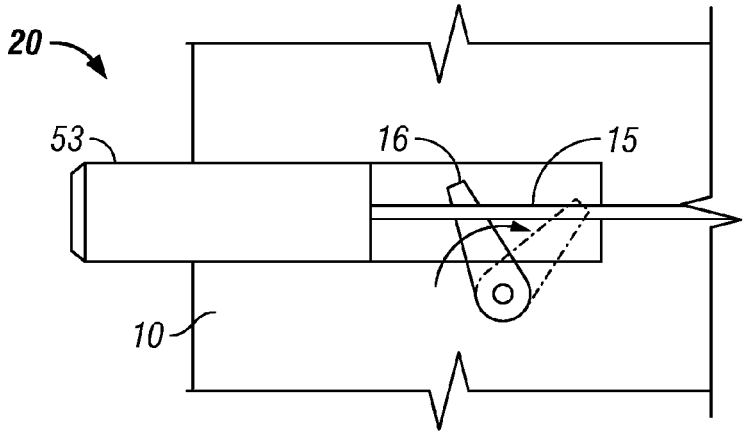
Figure 5C:
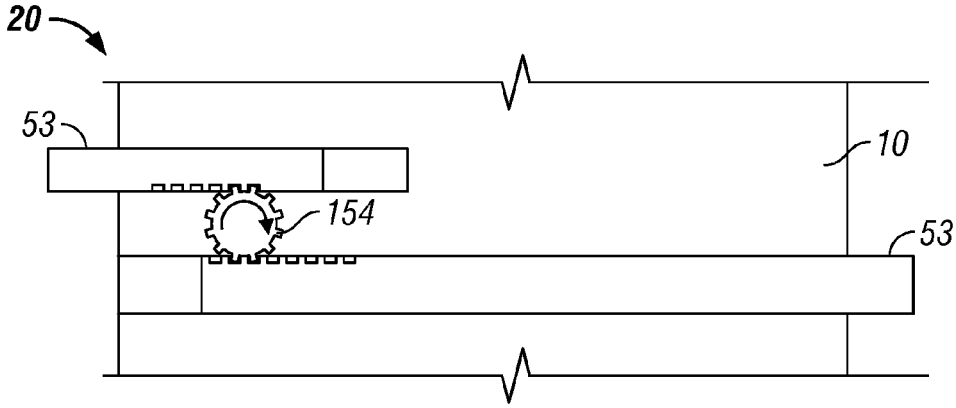

FIGS. 5*a-c* illustrates various actuating mechanisms 20 for extending and contracting security members, such as telescoping member 19 and 29. As illustrated FIG. 2, the actuating mechanism 20 can be activated by a key from the exterior of the barrier and/or a handle 22 or knob on the interior of the barrier. FIG. 5*a* illustrates an actuating mechanism suitable for use with telescoping rods, such as the embodiment shown in FIG. 2. More specifically, the security member 19 may have an actuation portion 15 therein so that a pawl 16 or other such structure can react against the actuation portion 15 and cause the member 19 to extend or contract as desired. FIG. 5*b* illustrates another embodiment in which an actuation lug 16 engages a slot 15 or opening in the locking member 53 to cause its actuation. FIG. 5*c* illustrates a rack and gear 55 systems may be used on bidirectional security members 53.

Figure 6:
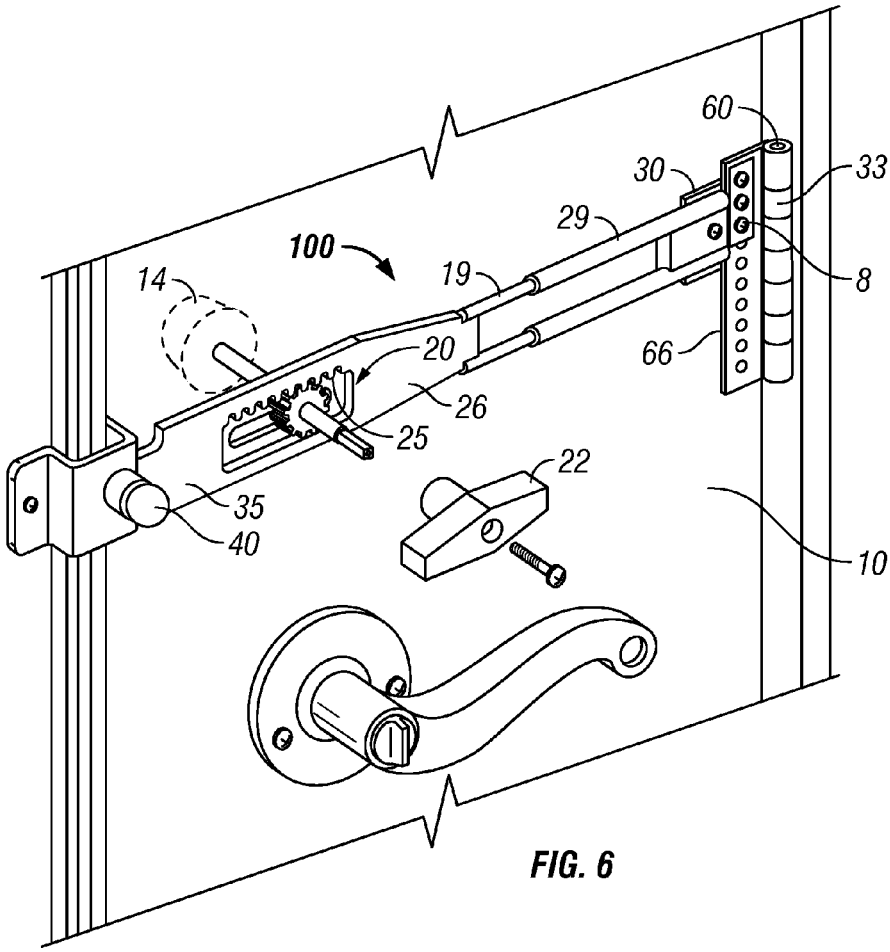
FIG. 6 illustrates another embodiment of the improved security system.

FIG. 6 illustrates an alternate embodiment of the improved security system 100. This system 100 may comprise a security member 35 that is constructed from a flat plate 26 on one end and one or more telescoping members 19, 29 on the other end. Typically, but not always, the flat plate 26 end of the security member 35 will be associated with the edge of the barrier 10 opposite the hinge 30 edge. Integral with the plate 26 portion may be an actuating mechanism 20, such as a rack and pinion gear arrangement (as illustrated) or a lever-type arrangement (not shown). It is preferred that the actuating mechanism 20 be associated with a dead bolt 14 and be actuatable from outside the barrier 10, such as by a key, and from inside the barrier, such as by a key or handle 22 or other device that can impart rotary motion. This embodiment may also include an override mechanism 40 that prevents the actuating mechanism 20 from operating when the mechanism is engaged. In another embodiment, the override mechanism 40 may be a pin that holds the security member in its extended or locked condition. Also illustrated in FIG. 6 is hinge portion 66 embodiment having vertical adjustability for securing the security member 35 at the appropriate height relative to existing lock systems, such as a dead bolt 14. Hinge portion 66 may connect to a standard door hinge 33 with a longer pin 60, allowing the security system to be installed in a level plane with a centerline of deadbolt 14 on barrier 10. This is accomplished, for example, by selecting typically three holes of many available over the vertical length of hinge portion 66 that levels the security assembly parallel to the floor, then attaching the two parts 30 and 66 with fasteners 8, such as machine screws or rivets. Aesthetic or cosmetic covers have been omitted for clarity.

Figure 7:
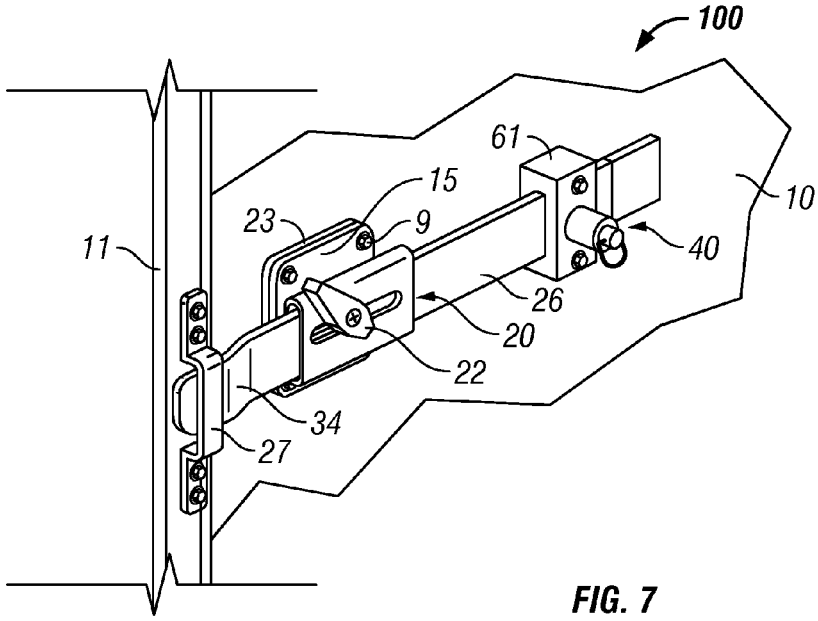
FIG. 7 illustrates another embodiment of the improved security system having a shortened security member.

FIG. 7 illustrates another embodiment of the improved security system 100 adapted to cooperate with an existing deadbolt lock 14 installed in the door 10. In this embodiment, security member 34 is shortened to eliminate the telescoping hinge 30 end of the previously described embodiments. It is supported and aligned with an adapter plate 15 that is spaced away from door surface 10 as required with spacer(s) 23, and in combination secured to door 10 with typically four long wood screws 9. A clasp 27 may be secured to the doorjamb 11 with preferably four screws or carriage bolts that penetrate the entire width of the doorjamb material for structural support against outside impact forces. In addition, an override mechanism 40 with locking detent pin may be attached to rear support block 61 would prevent entry to the interior even if the entrant has the correct key for the deadbolt lock 14. A cosmetic cover (not shown) may be provided to conceal the system's working mechanism.

Figure 8:
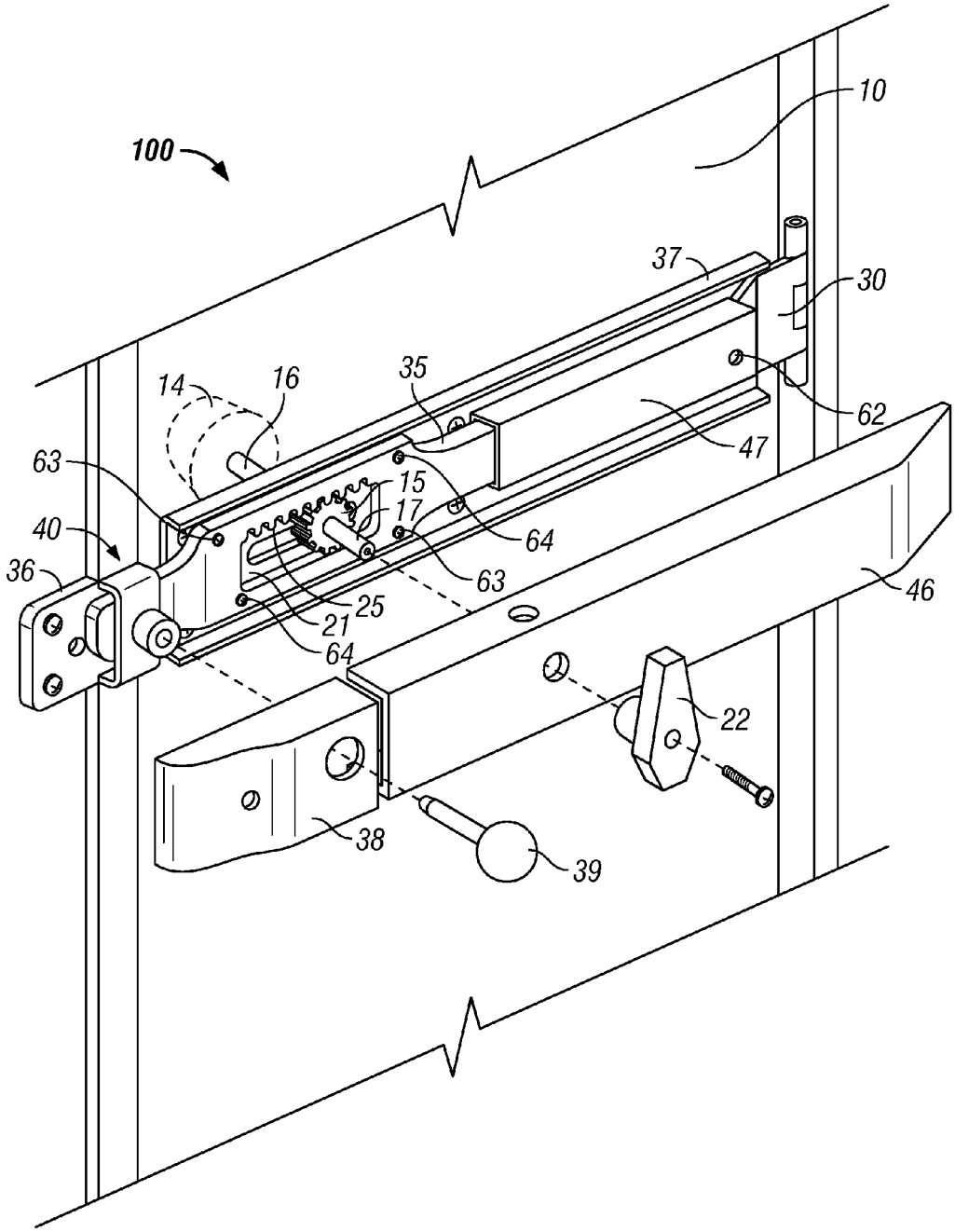
FIG. 8 illustrates a presently preferred embodiment of the improved security system.
Figure 14A:
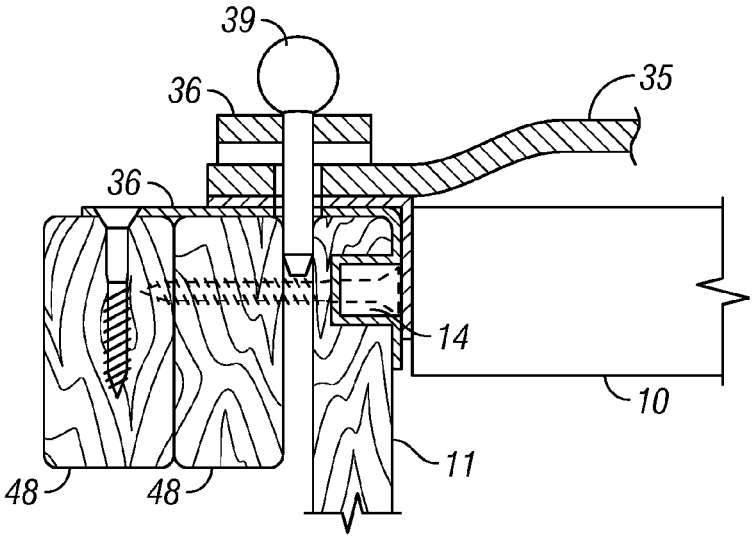
FIGS. 14*a-e* illustrate several embodiments of override mechanisms suitable for use with the improved security systems disclosed herein.
Figure 14B:
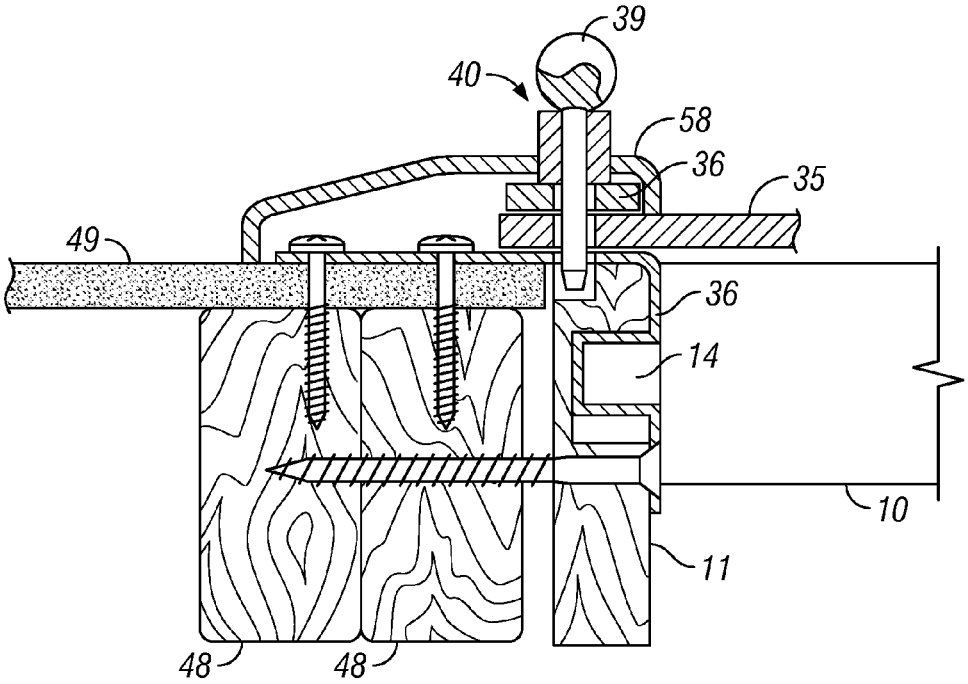
Figure 14C:
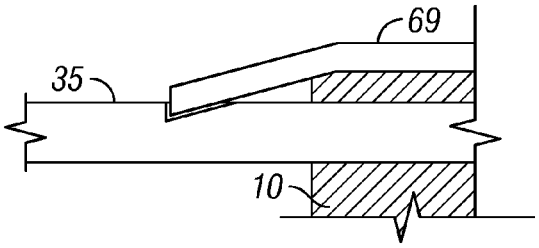
Figure 14D:
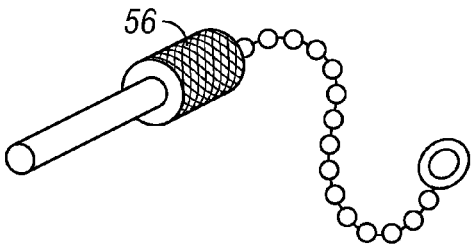
Figure 14E:
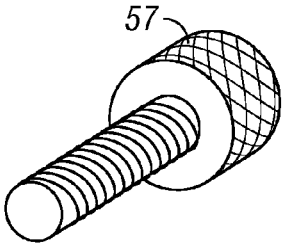

FIG. 8 illustrates a presently preferred embodiment of the improved security system 100. The heavy duty, heat treated bar 35 telescopes within a hollow rectangular tube 47 that is pinned at the rear with pin 62 providing the ability to swivel up or down ±20° as may be required for certain out-of-horizontal installations. Preferably, clasp 36 is of a more robust design than clasp 27 and is capable of transferring loads directly into the building structure for even more added strength against forced entry, while providing a location for installing the over-ride mechanism, such as locking pin 39, or a ball detent pin 40 as shown in FIGS. 14*a* and 14*b*.

Member 35 may be provided with two sets of through holes 63 and 64 to facilitate assembling the member 35 to back support plate 21 to secure segment gear shaft 17 and gear 18. Holes 63 are used when the 2⅛" diameter through hole has a backset from the edge of the door of 2⅜" (60 mm), while holes 64 are used for backsets of 2¾"(70 mm). Sufficient rack teeth 25 are provided to "time" the segment gear so it provides the necessary 1" of bar travel, such as by the two flat surfaces forming the balance of the perimeter of the segment gear coming against the flat bottom surface of the rack rectangular window 25. Details of hinge 30 were previously described in FIGS. 3 and 4 above, and essentially operate in the same manner. Decorative covers 38 and 46 may snap into place and be retained by parts 36 and 37, respectively. Handle 22 allows manual operation of the lock assembly from the interior side of the door. The aforementioned dimensional embodiment is exemplary only as one of ordinary skill in the art could readily modify the dimensions, backsets and gear permitted to accommodate any barrier.

Figure 9A:
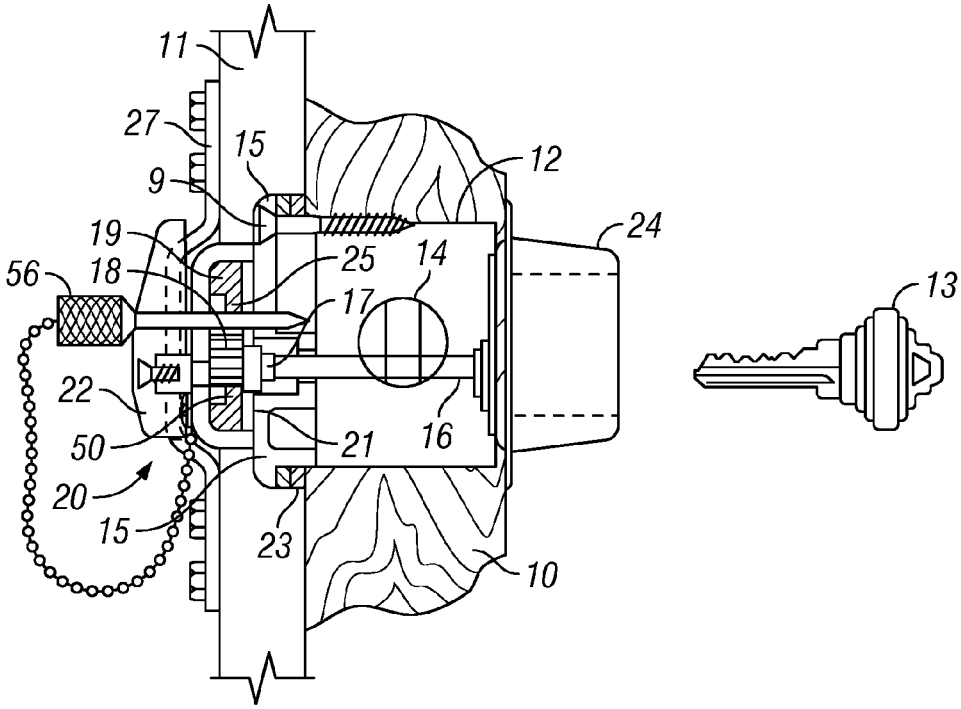
FIGS. 9*a-b* illustrate in cross section an embodiment of an actuating mechanism with override suitable for use with the improved security system.
Figure 9B:
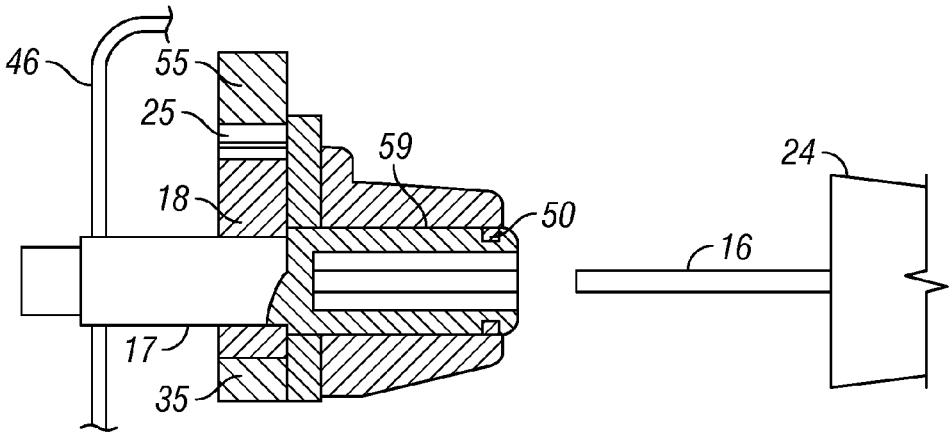

FIGS. 9*a* and 9*b* illustrate a cross section of an actuating mechanism 20 suitable for use with the preferred embodiment illustrated in FIG. 8. The actuating mechanism 20 is associated with a conventional dead bolt 14. A segment gear 18 and shaft 17 engage a mating toothed gear rack 25, which is an integral part of the steel security member 35. FIG. 9*a* illustrates combined rotation of this shaft 17 by the external deadbolt 14 by drive shaft 16 of key lock 24 using key 13, or handle 22 on the interior of the door, which is mounted to shaft 17. Rotation causes the steel bar to shift about 1" distance, sufficient to engage clasp 27 positively so the door is secured and cannot swing open until the bar 35 is again released to the unlocked position. Spacers 23 can be installed between the door 10 and adapter plate 15 as required to position the steel bar 35 or rods 19 to enter clasp 27 effortlessly.

An adapter mounting plate 15 provides the necessary bearing bore for supporting shaft 17 directly in line with the key-lock 24 drive shaft 16, as well as providing a means of retaining the shaft 17, gear 18, rack 25 or rod 19 with snap ring 50, which must be compressed with an axial force of preferably about 40-60 pounds to insert into the bore 59, then pass through bore 59 and expand at the end of the bore into an internal recess at the inner end of the bore, thereby trapping the ring 50 so it can be compressed properly when the reverse disassembly sequence is necessary. Lubrication of bore 59, such as with Molydisulfide grease, will aid the assembly and provide operating lubrication during the use of the locking system 100, and may also be added to the gear and rack interface for smooth operation. FIG. 9*b* shows a cover 46 added in another embodiment of the system 100.

Figure 10:
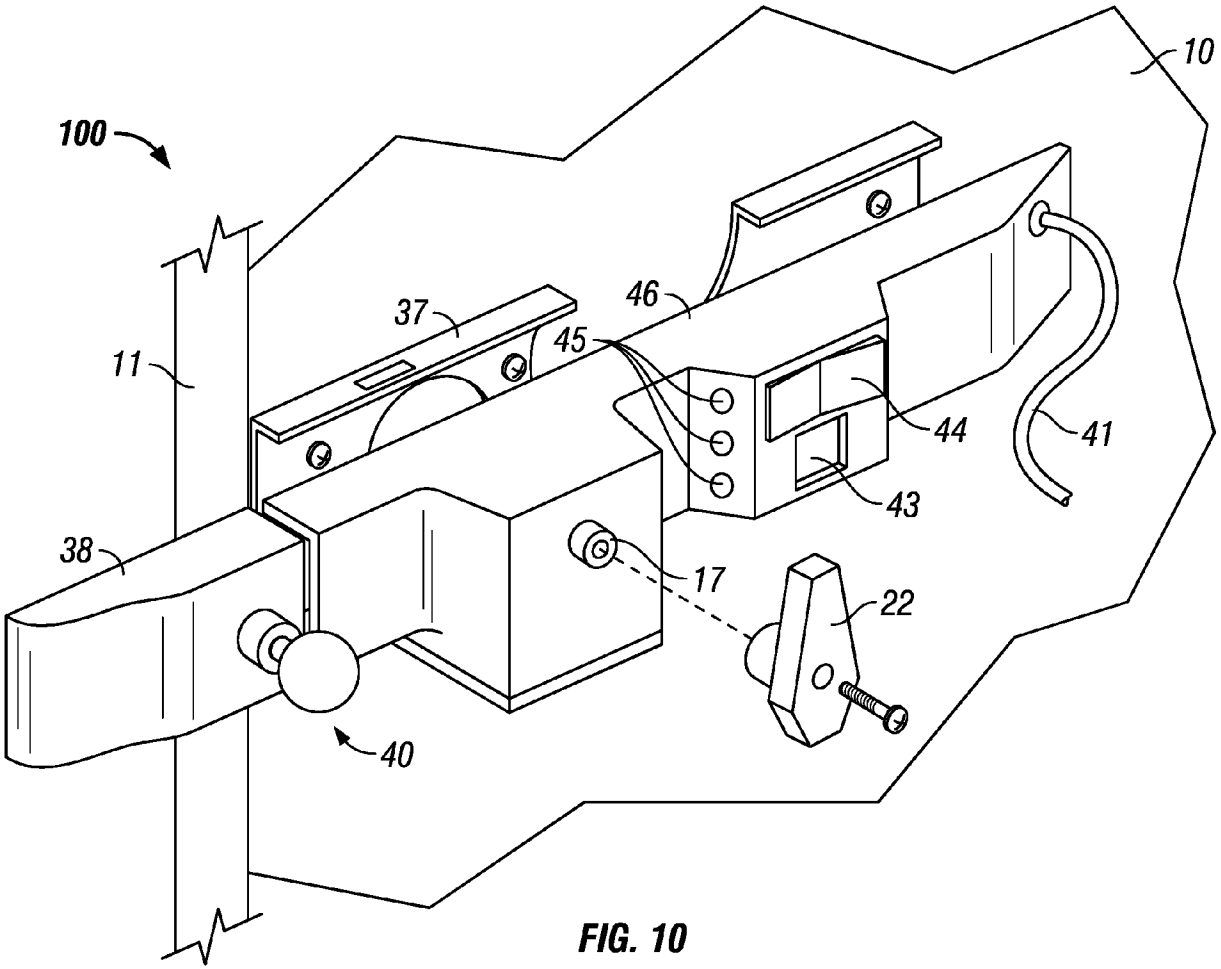
FIG. 10 illustrates another embodiment of the improved security system.

FIG. 10 illustrates a system 100 similar to that shown in FIG. 8, but includes a more advanced cover 46 containing a motor drive to electrically move the member 35 to the locked and unlocked positions, and LED's 45 or other indicating devices to indicate the security system 100 as "locked" or "unlocked." This embodiment may also include one or of the security devices illustrated in FIGS. 11*a*-11*f*, such as biometric fingerprint recognition 43 capabilities, which could be connected to surveillance and alarm systems or used for actuation and/or override of the security system 100. Also, a simple toggle switch 44 may be provided to operate the locking bar 35 from opened to closed postions. As usual, a handle 22 may be provided for manual operation of the lock in the unlikely event of power or battery failure.

Figure 11C:
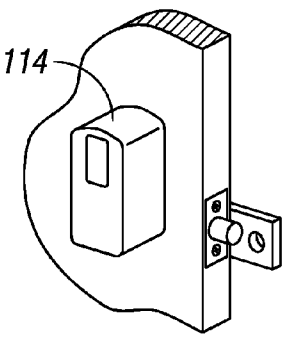
FIGS. 11 *a-f* illustrate multiple different embodiments of actuating mechanisms and/or override mechanisms that may be used with the improved security systems disclosed herein.
Figure 11F:
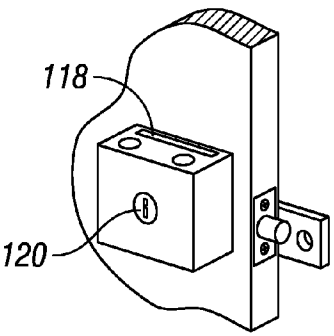
Figure 11B:
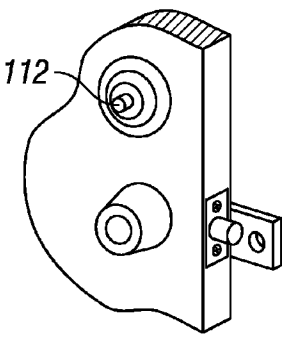
Figure 11E:
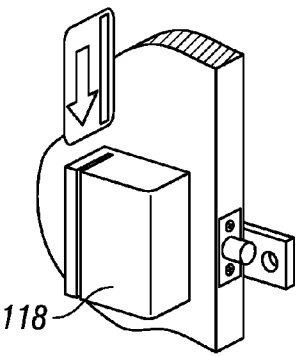
Figure 11A:
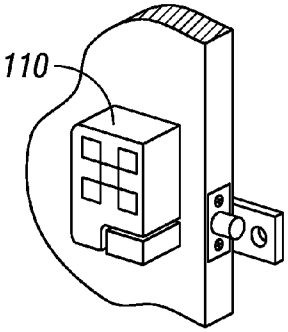

FIGS. 11*a*-11*f* show the many different types of security devices that may be incorporated into any of the embodiments described herein. For example, FIG. 11*a* illustrates a mechanical or electrical push button coded lock 110. FIG. 11*b* illustrates a conventional combination lock 112. FIG. 11*c* illustrates a biometric device, such as fingerprint scanner 114.

Figure 11D:
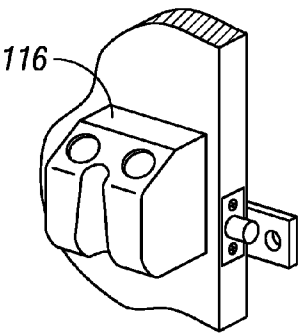

FIG. 11*d* illustrates another biometric device, such as a retina scan 116. FIG. 11*e* illustrates a magnetic, mechanical, or smart card reader 118. One or more of these devices may be incorporated into an improved security system 100 to prevent unwanted actuation. For example, FIG. 11*f* illustrates a combined card reader 118 and key lock 120. These and similar devices may be used to cause actuation of the system 100 from the opened to the locked condition, or may be used to prevent unwanted release of the override mechanism 40.

Figure 12:
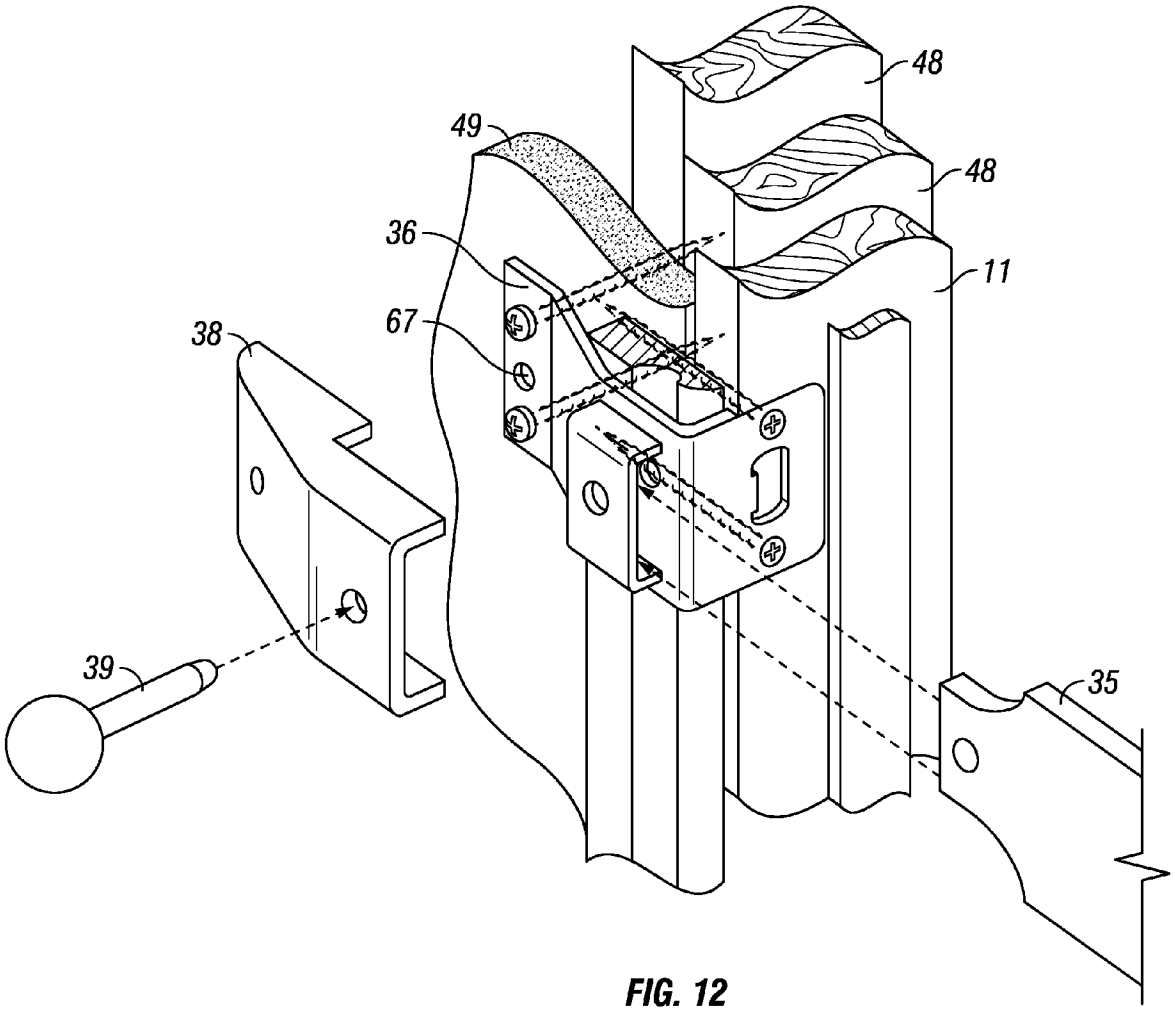
FIG. 12 illustrates a security member receptacle suitable for use with the improved security system.

Referring back to FIGS. 1 and 2, it is apparent that present deadbolt 14 construction may be weak in the area of the striker plate 58, wherein not much structure, e.g. wood or metal, remains to absorb heavy impact forces suddenly applied to the exterior surface of the door 10 in the immediate area of the deadbolt. FIG. 12 illustrates a more robust striker/clasp combination 36 having preferably four retaining screws or bolts to reach deep into the studs 48 of the wall construction, or self-tapping steel screws or machine screws fastening the receptacle to steel jambs 11 or steel studs 48. Override pin 39 is illustrated as a separate element that will pierce through the holes in the receptacle and the hole in the end of security bar 35, preventing any chance of the lock being violated. Receptacle 67 can be used to store the pin 39 when not in use.

Figure 13:
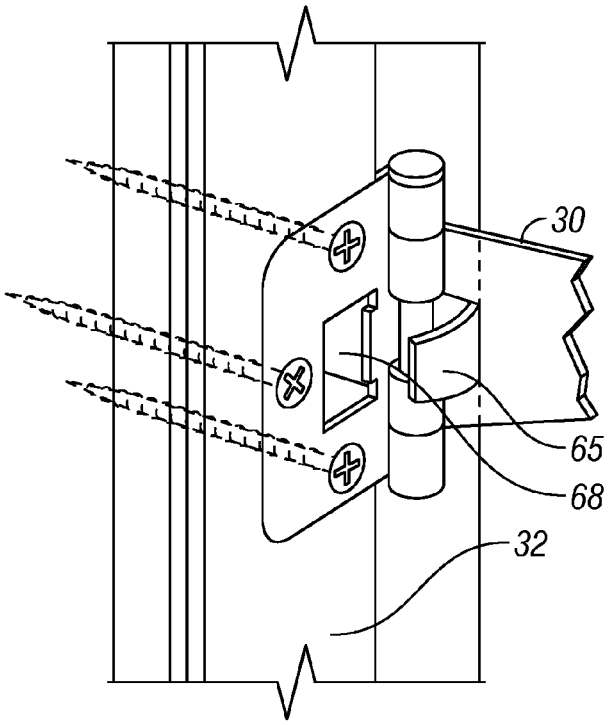
FIG. 13 illustrates an alternate embodiment of a hinge suitable for use with the improved security systems disclosed herein.

FIG. 13 illustrates another embodiment of the hinge 30 that may increase strength against impact forces. A tab 65 enters the striker type hole 68 in the adjacent mating hinge shown when the door is closed, thereby providing one more barrier against forced entry.

Referring to FIGS. 14*a-e*, while most any type of fastener, such as thumb screw 57, pawl 69 or chained pin 56 may be used as an override mechanism to restrain the security bar 35 from being shifted to the open unlocked position, such will be susceptible to being lost or misplaced. A permanent type detent pin 39 (FIG. 14*b*) is disclosed as a method of positively securing the security bar 35 against unauthorized movement. The snap ring detent pin provides a way of rapidly and positively keeping the security bar 35 in the locked position. Pin 39, whether a loose entity or a component of a sub-assembly 40, works in harmony with receptacle bracket 36 to restrain security bar 35 by passing through multiple layer of steel. The middle layer (moveable) being bar 35 and the two outer layers (stationary) being receptacle 36. The pin may be housed within an outer steel cylinder 40 having two shallow grooves at each end of the internal length of the cylinder bore that receive a segmented round wire ring (about 320° circumference) floating in a shallow groove strategically located along the length of the pin shaft diameter, and which is slightly larger than the pin diameter so that it will mate with the corresponding grooves in the cylinder. The pin is thereby prevented from inadvertent movement by vibration no matter which position it is in. The steel cylinder 40 is coupled, such as by welding to the "U" shaped catch portion of the receptacle 36 in line with the mating hole in the receptacle bracket first wall. Once the bracket 36 is installed into the structure of the building, it is a simple matter of drilling a relief hole directly in line with the pin so the free end of the pin can be assured of passing freely through the third layer of steel until the detent ring is engaged with the mating groove in the locked position.

Another version of this detent arrangement would be a similarly designed device that has a preferably shorter stroke that lets the snap ring retaining pin 39 engage the bar 35 only at its full detent position, not passing through the third layer of steel, as the force to defeat this pinned locking arrangement would still be very substantial. This also negates the need to drill a relief clearance hole into the woodwork or structure behind the receptacle bracket 36. Loose retainer locking pins will work with the present system 100, but are susceptible to being lost, misplaced or stolen.

Figure 15A:
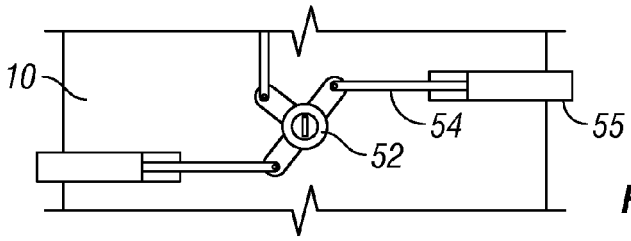
FIGS. 15*a-b* illustrate other embodiments of an improved security system.
Figure 15B:
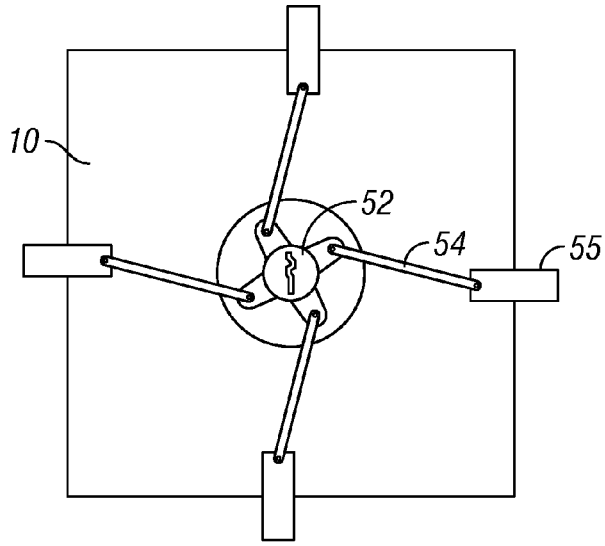

FIGS. 15*a-b* illustrate an improvement of the security system originally disclosed in U.S. Pat. No. 6,481,252, which disclosure is incorporated by reference herein for all purposes. FIGS. 15*a* and 15*b* illustrate securing a door 10 to its opening at multiple points of two, three, four or more with members 54 driven by "I", "Y", "X" shaped pivot arm 52 rotating about its keyed and levered axis that drives various push rods 55. Such an arrangement could work well for a door that swings open in both directions about a three leaf, double acting set of hidden or enclosed hinges, and may be very suitable for securing commercial building entrance doors, required by building and safety codes, to open to the outside world. Also in very confined spaces, such as aircraft cockpit doors, a door with multiple points of retention would offer increased safety to pilots against unauthorized entry. This expands the alternate embodiment of the previously patented security lock to include multiple bolts extending from three or four edges of the door by using "Y" and "X" shaped center members. These elements can be on the inside surface of the door, or installed in the interior center section of the door at the door assembly plant and may be combined with one or more of the other structures disclosed herein.

Figure 16:
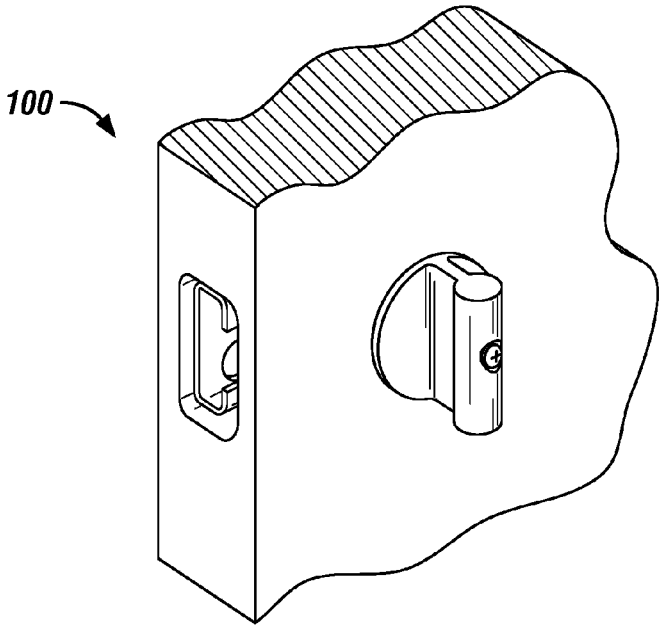
FIG. 16 illustrates an improved security system as described herein installed in a door during manufacture.

FIG. 16 illustrates an improved security system 100 installed in a door by the door manufacturer. It will be appreciated that the improved security systems 100 described herein may be used to retrofit existing doors or may be manufactured into doors for original sale.

Figure 17:
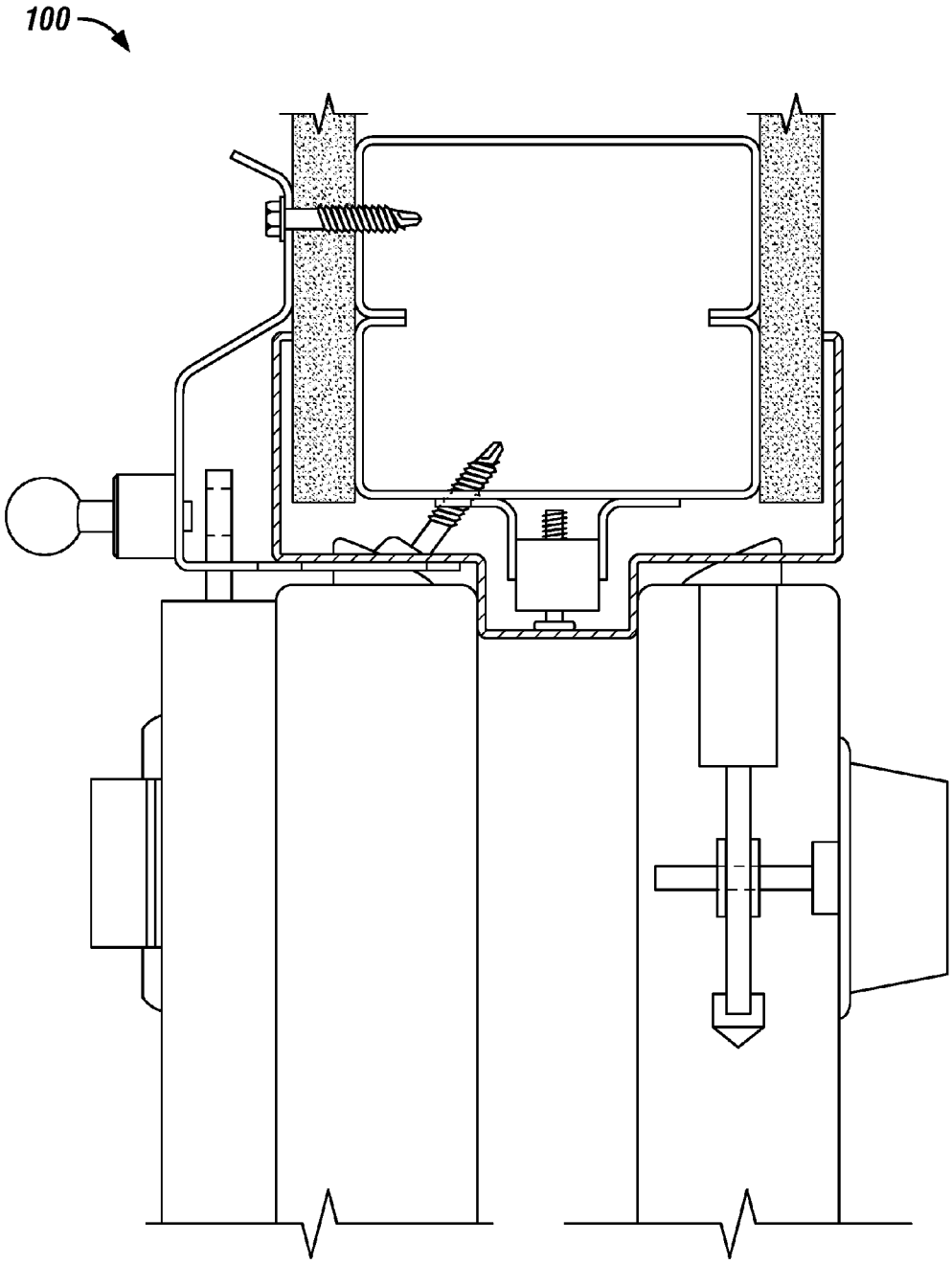
FIG. 17 illustrates a composite view of a conventional locking system and an improved security system according to this disclosure.

FIG. 17 illustrates a composite of a conventional door lock system on the right and an improved security system 100 according to the present invention. This FIG. illustrate the adaptability of the improved system 100 to metal stud construction techniques and illustrates the use of a self-tapping screw through the latching bolt receiver for added strength.

Figure 18:
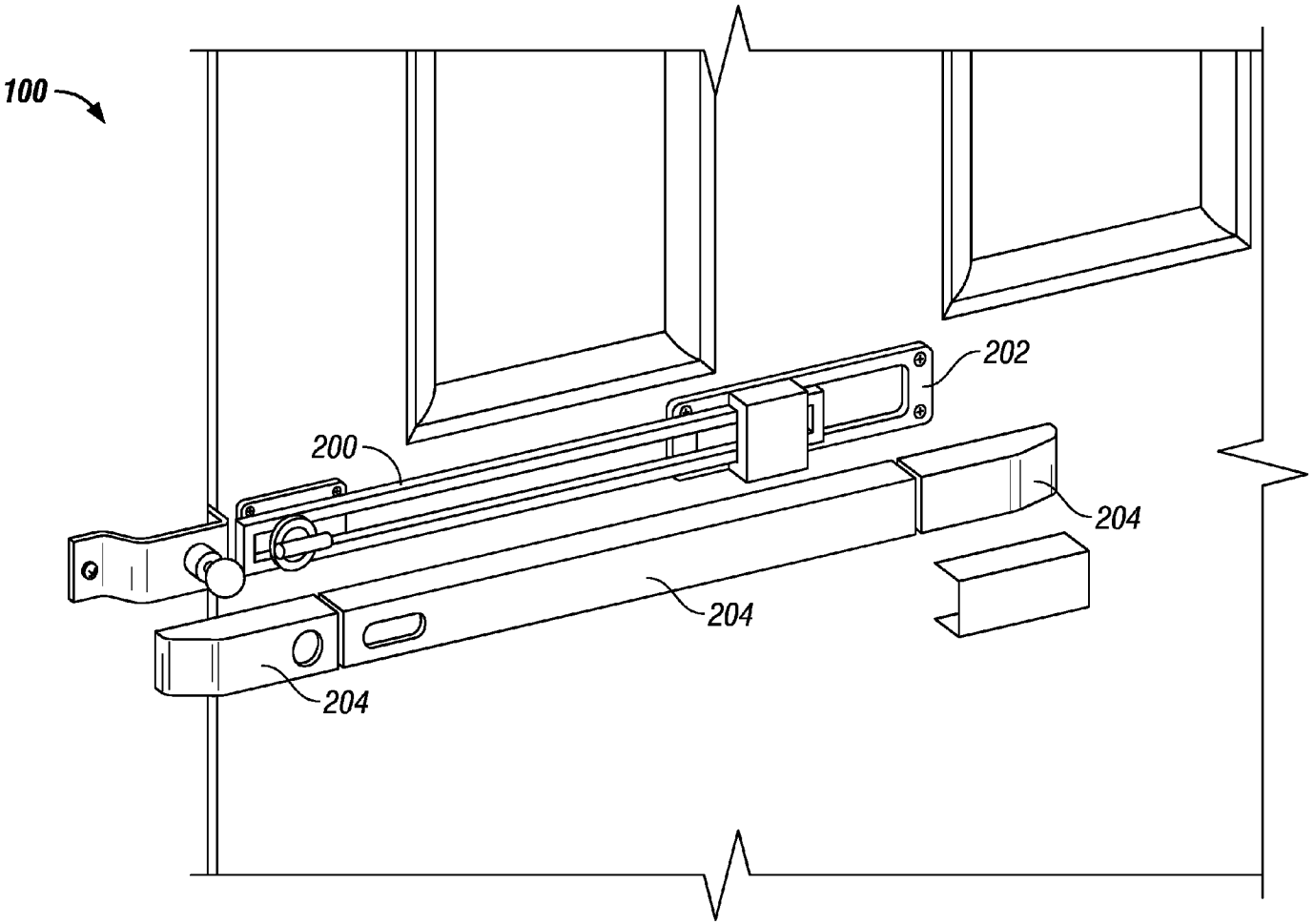
FIG. 18 illustrates a presently preferred embodiment of an improved security system utilizing a single steel channel.

FIG. 18 illustrates an alternate embodiment of an improved security system 100 comprising a single channel 200. It will be noted that this embodiment does not extend from door jamb to door jamb, but rather extends from about the middle of the door to the un-hinged door jamb. This system 100 comprises a bracket 202 that is secured to the door by fasteners. Unlike the improved security systems disclosed above that span jamb-to-jamb, this system 100 is not required to rotate at the bracket 202, but may if desired. Also shown in FIG. 18, is cover 204 to provide an aesthetically pleasing appearance and/or to prevent dirt and other contamination from affecting the system. The functionality and structures of the system 100 disclosed in FIG. 18 are similar to the functionality and structures previously discussed.

Figure 19A:
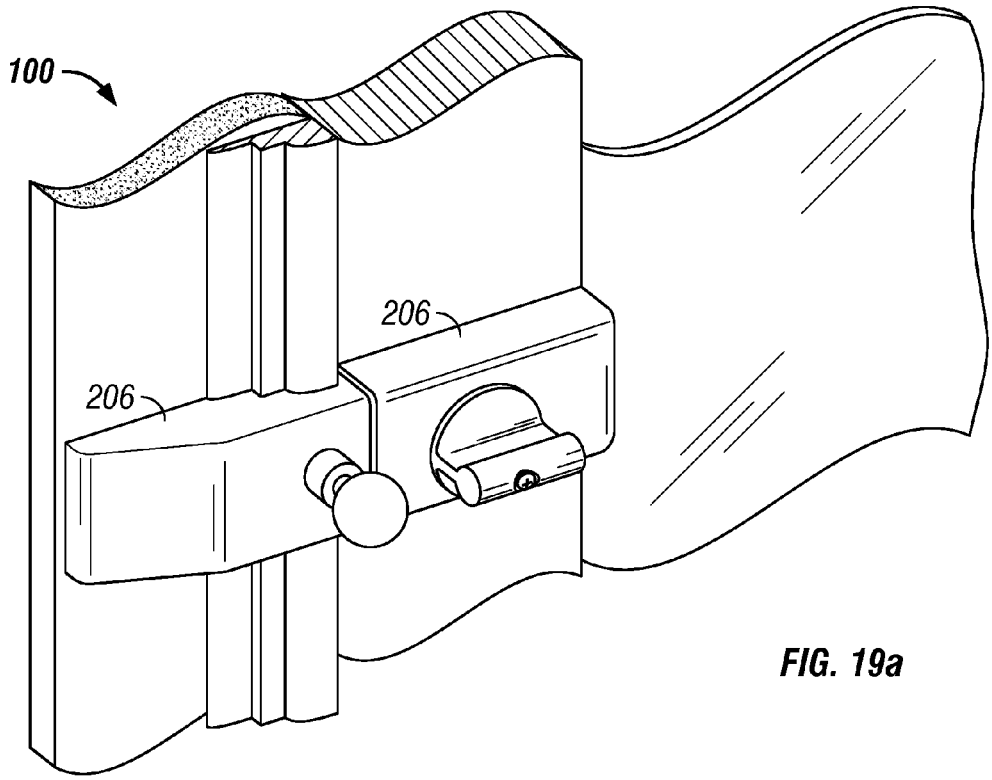
FIGS. 19*a* and 19*b* illustrate an alternate embodiment of an improved security system for glass-bearing or non-solid doors.
Figure 19B:
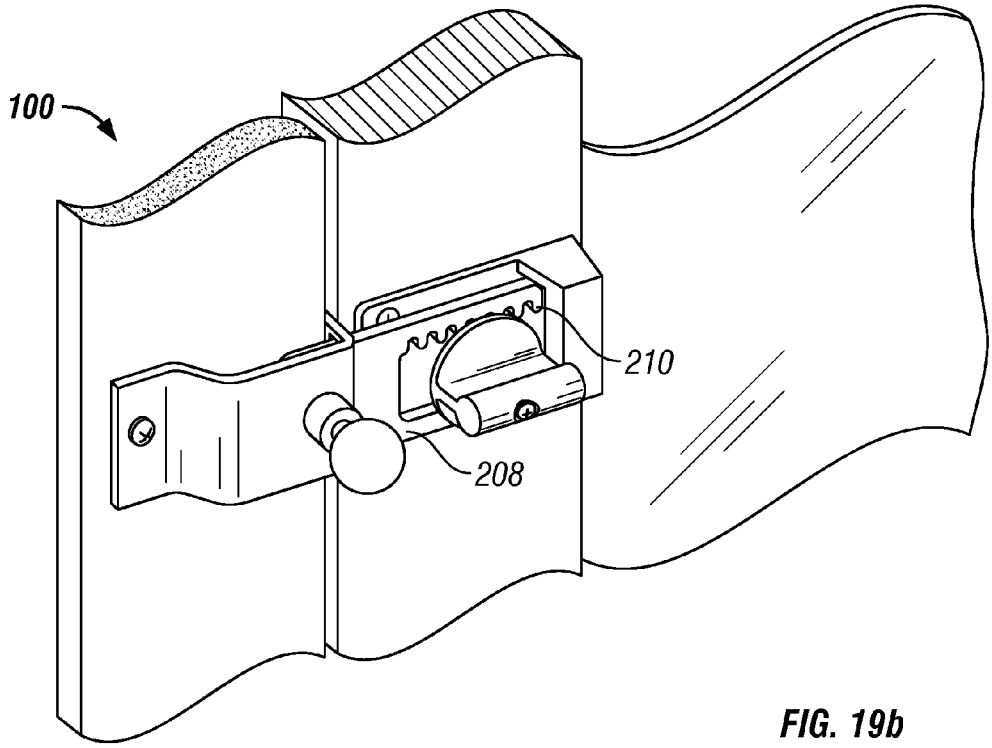

FIGS. 19*a* and 19*b* illustrate another alternate embodiment of an improved security system 100. It will be noted that like FIG. 18, these embodiments do not extend from door jamb to door jamb. Unlike FIG. 18, these embodiments extend from about the opening edge of the door to the un-hinged door jamb. This system 100 is particularly suited for doors having glass panes or for when full-span or half-span systems are not desired. FIG. 19*b* shows the system 100 with the cover 206 removed. It will be appreciated that the locking bar 208 may extend or retract by virtue of a rack and gear system 210 similar to that described for FIGS. 5 and 6. Also, any of the other extension/retraction mechanisms may be employed as desired. The functionality and structures of the system 100 disclosed in FIG. 19 are similar to the functionality and structures of systems 100 previously discussed.

Figure 20:
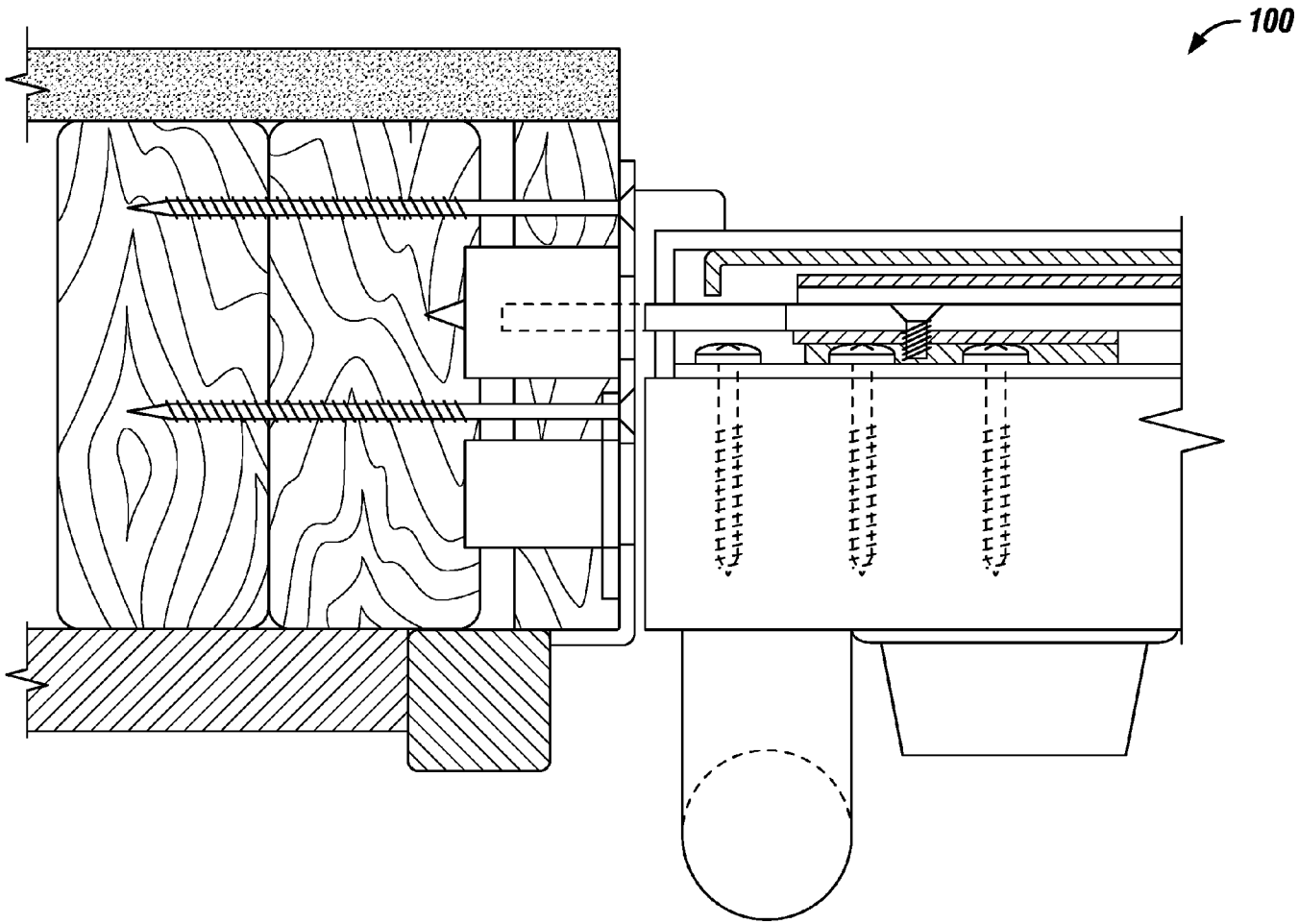
FIGS. 20, 21 and 22 illustrate embodiments of an improved security system for outward-opening doors.
Figure 21:
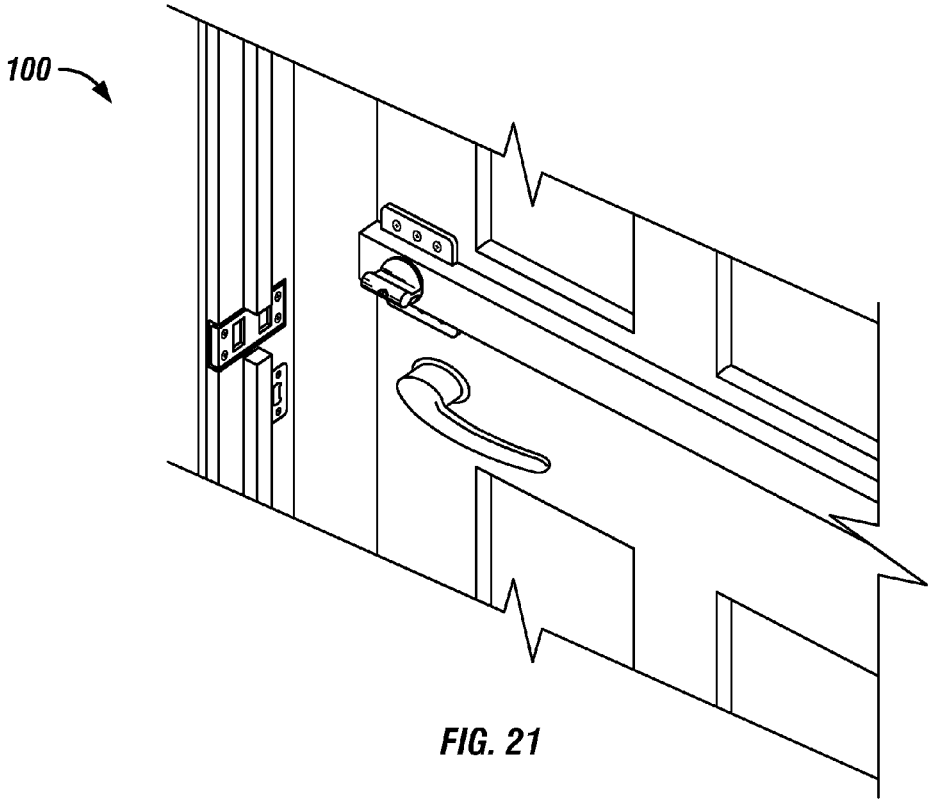
Figure 22:
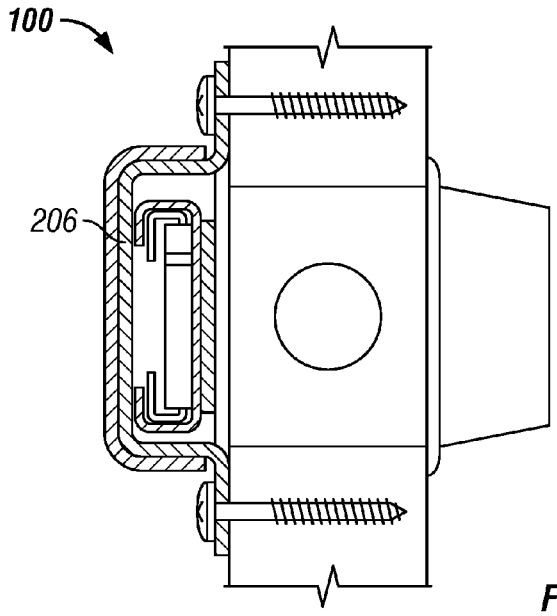

FIG. 20 illustrates an improved security system 100 adapted for use with outwardly opening security barriers. It will be appreciated that for retrofit applications (in contrast to OEM installations) the system 100 is located on the interior surface of the barrier. FIGS. 21 and 22 illustrate an interior view and an edge view, respectively, of the improved system 100 illustrated in FIG. 20. The functionality and structures of the system 100 disclosed in FIGS. 20, 21 and 22 are similar to the functionality and structures of systems 100 previously discussed.

Figure 23:
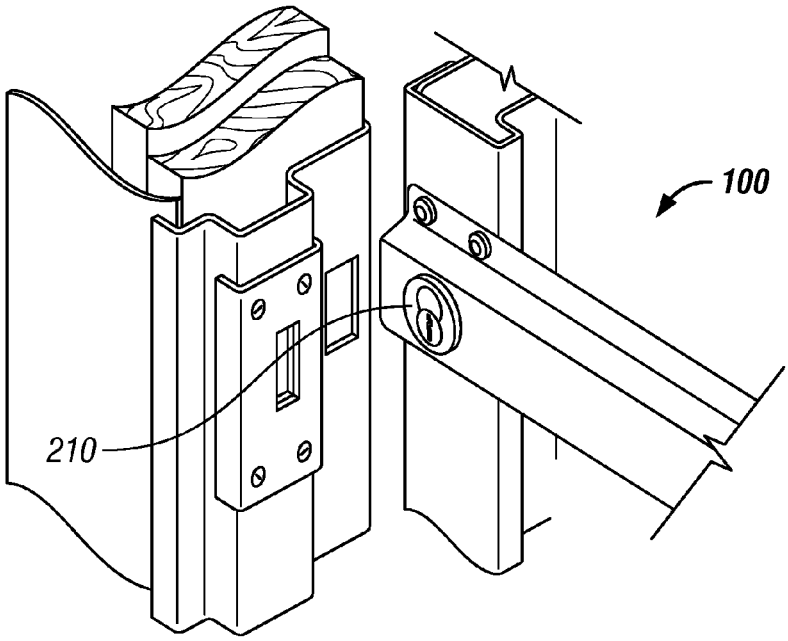
FIG. 23 illustrates an alternate embodiment of an improved security system for outward-swinging glass-bearing or non-solid doors.

FIG. 23 illustrates an improved security system 100 adapted for use with outwardly opening, glass-bearing door. This embodiment is shown with a keyed actuation mechanism 210 so that is if the glass or other breakable barrier is compromised, the intruder is not able to turn a knob to unlock the system 100. The system 100 illustrated in FIG. 23 is a jamb-to-jamb installation, but it will be appreciated that any of the other system 100 embodiments disclosed herein may be utilized as desired. The functionality and structures of the system 100 disclosed in FIG. 23 are similar to the functionality and structures of systems 100 previously discussed.

Figure 24:
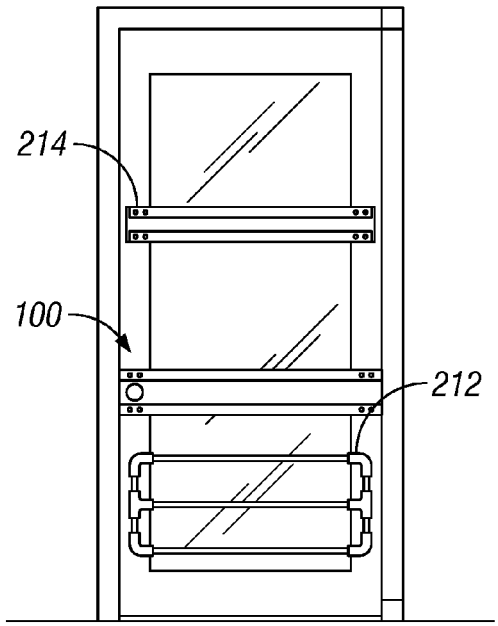
FIG. 24 illustrates additional security features for glass-bearing or non-solid doors.

FIG. 24 illustrates additional security features that may be utilized with an improved security system 100 (or without) and are especially beneficial for doors having breakable components such as glass. A barrier 212 or 214 may be affixed adjacent the breakable component to impede and/or prevent access through the broken component. Barriers 212 and 214 may comprise a series of bars, metal channels or wire grating or mesh or other similar structures as illustrated FIG. 24.

Figure 25A:
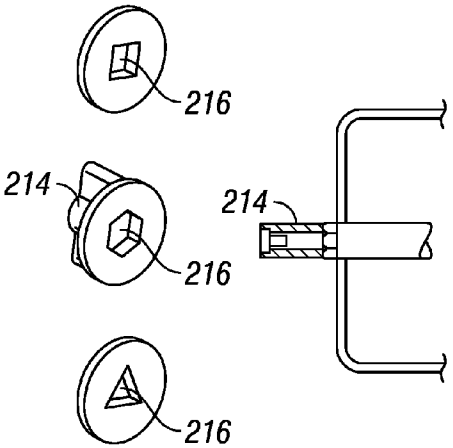
FIGS. 25*a* and 25*b* illustrate additional security features for glass-bearing or non-solid doors comprising removable interior knobs.
Figure 25B:
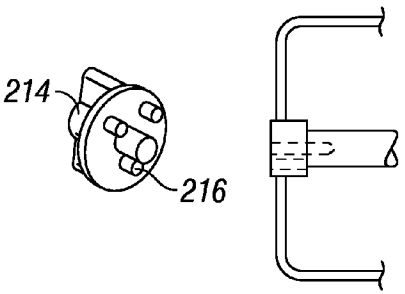

FIGS. 25*a* and 25*b* illustrate an additional security feature for use with an improved security system 100, and preferably for use with barriers having breakable components. As pointed out above, if the breakable component of the barrier is compromised the intruder may be able to reach in and manipulate a locking knob or other element. Shown in FIGS. 25*a* and 25*b* are knob shafts 214 having a key 216 for receiving a knob (not shown). It will be appreciated that when the barrier is locked, the inhabitant may simply remove the knob and store in a safe place until needed by the inhabitant. If a protruding shaft is left after the knob is removed, it may be desired to fit the shaft with a floating sleeve to prevent the intruder from rotating the protruding shaft with a tool.

Figure 26:
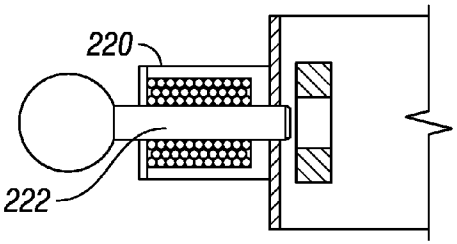
FIG. 26 illustrates an additional security feature for the improved security system comprising an electronically actuated secondary lock.

FIG. 26 illustrates an additional security feature for use with an improved security system 100. As discussed above with respect to, for example, FIGS. 6 and 8, a secondary lock 40 is shown. In this embodiment, however, the secondary lock 40 may comprise and electromechanical device 220, such as a solenoid actuator. For actuators with a normally retracted pin 222, activating the solenoid will drive the pin 222 through the system 100 locking bar and into the pin receptacle. Activation may be accomplished by a manual switch located adjacent the device 220, or preferably by a wireless activation device, similar to a car fob for remotely locking and/or unlocking car doors. In this manner, improved security systems can be secondarily locked remotely. It will also be appreciated that similar devices 220 can be used to extend or retract the locking bar remotely as well.

Figure 27:
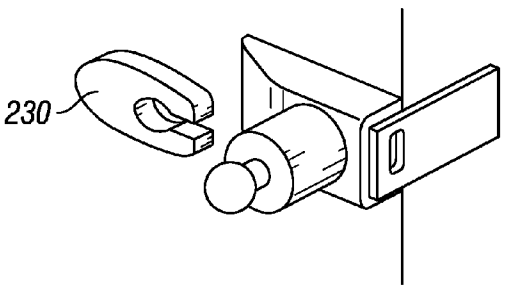
FIG. 27 illustrates a safety lock-out for a secondary lock.

FIG. 27 illustrates an additional security feature for use with an improved security system 100, which comprises a secondary lock lock-out feature 230 for preventing the secondary lock from engaging. The lock-out feature may comprise a clip or other structure that physically prevents the secondary lock pin from engaging the system 100 locking bar.

Figure 29:
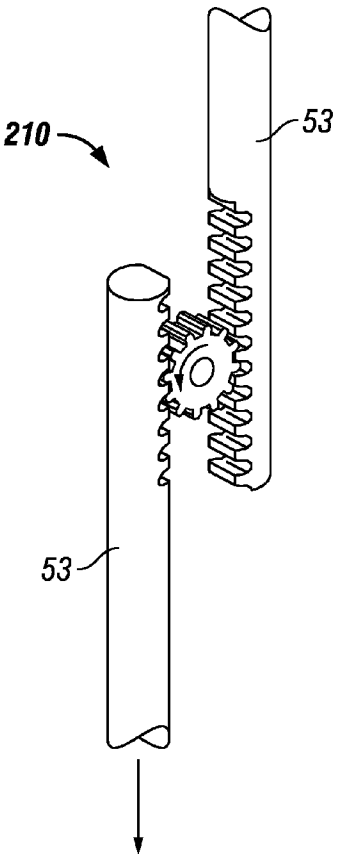
FIGS. 28, 29, 30*a* and 30*b* illustrate improved security systems for sliding patio doors.
Figure 28:
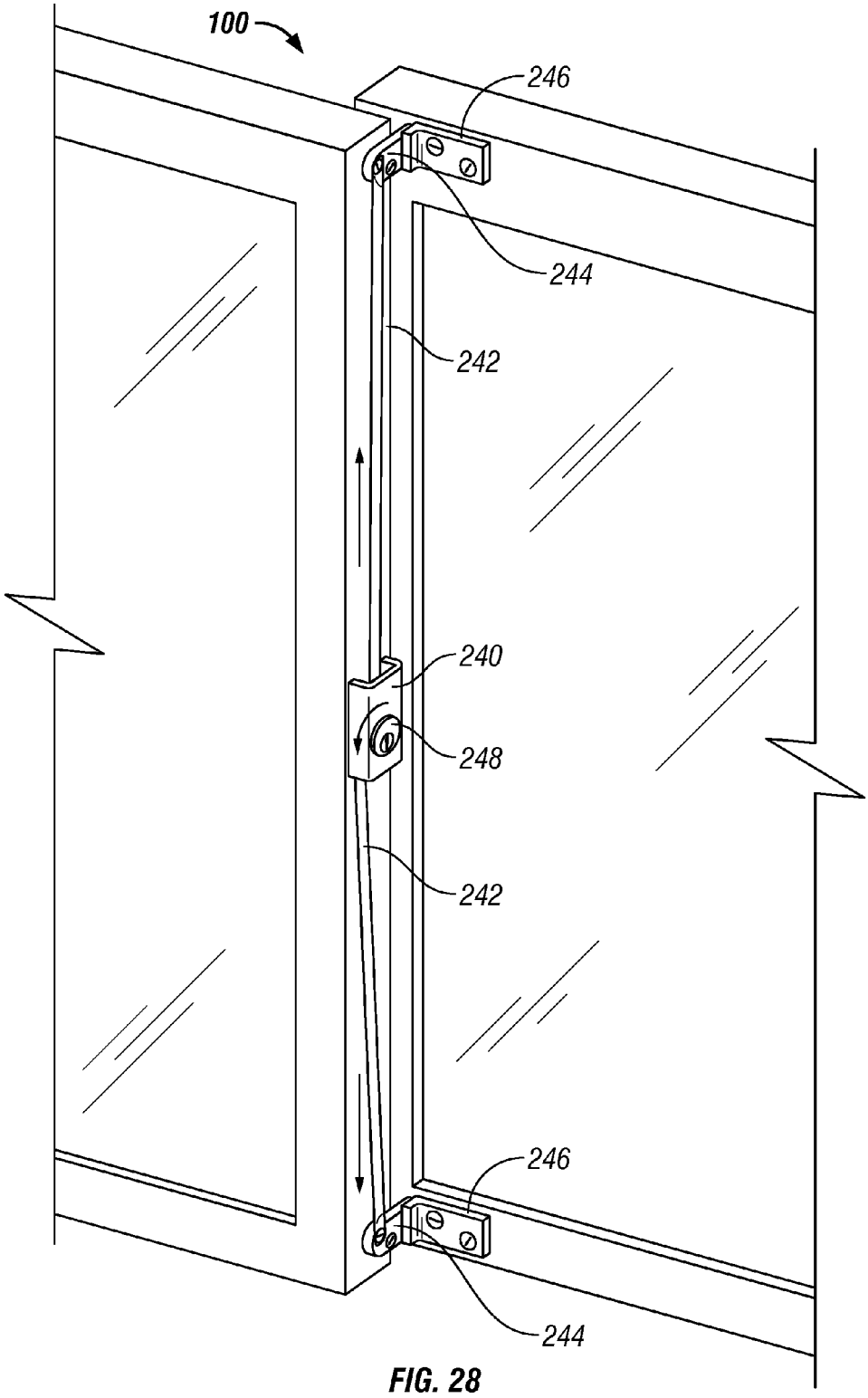

FIG. 28 illustrates another embodiment of am improved security system 100 for use with conventional sliding glass doors. The system 100 illustrated in FIG. 28 comprises an activation device 240, member 242, camming locks 244 and stops 246. It will be appreciated that camming locks 244 are pivotally connected to the sliding portion of the door as illustrated such that in a first position (not shown) the cams are located within the vertically oriented plane of the door so as to not interfere with sliding of the door. When the cams 244 and moved to a second position, e.g., 90 degrees from the first position, the cam protrude from the plane and are adapted to engage or react against stops 246, thereby locking the sliding portion of the door to the fixed portion of the door. It will be appreciated that the activation device 240 may comprise a rack and gear system 210 similar to that described for FIGS. 5, 6 and 19, as illustrated in FIG. 29, and may include, preferably a keyed lock 248 or removable knob or knob. Also, any of the other extension/retraction mechanisms may be employed as desired. The functionality and structures of the system 100 disclosed in FIGS. 28 and 29 are similar to the functionality and structures of systems 100 previously discussed.

Figure 30B:
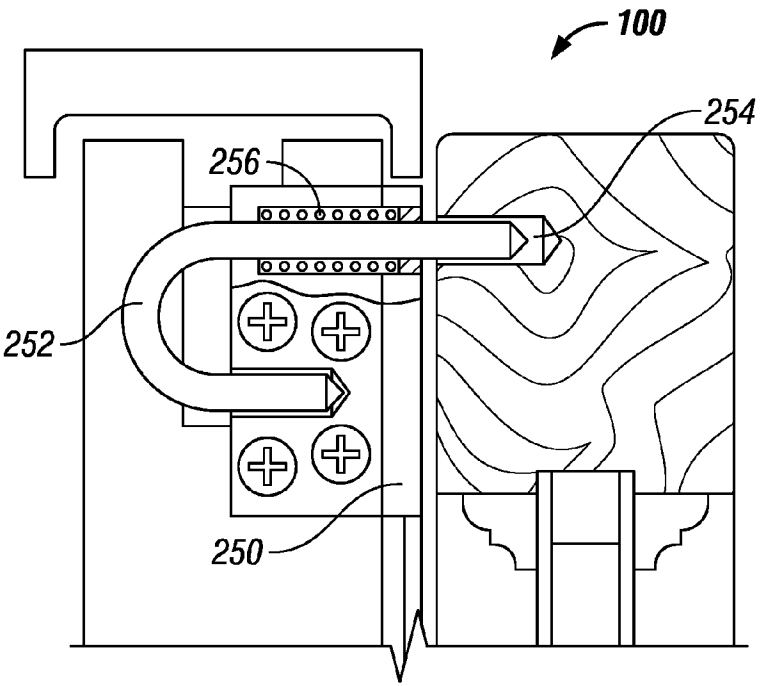
Figure 30A:
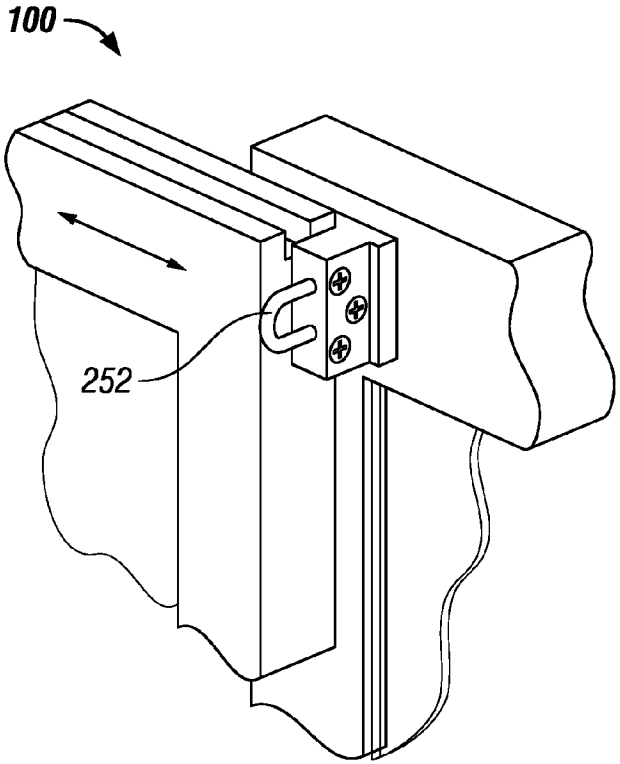

FIGS. 30*a* and 30*b* illustrate an alternate improved security system 100 for a sliding patio door. As best seen in FIG. 30*b*, the system 100 comprises a block 250 associated with the sliding portion of the door and a locking pin 252. When it is desired to lock the patio door, the locking pin 252 is passed through the block 250 and into a receptacle 254 in the fixed portion of the door, such as a drilled hole. The locking pin 252 may be spring 256 biased into the locking condition. When it is desired to unlock the system 100, the pin 252 is retracted and rotated so that the biasing force is overcome and the door remains unlocked.

Figure 31:
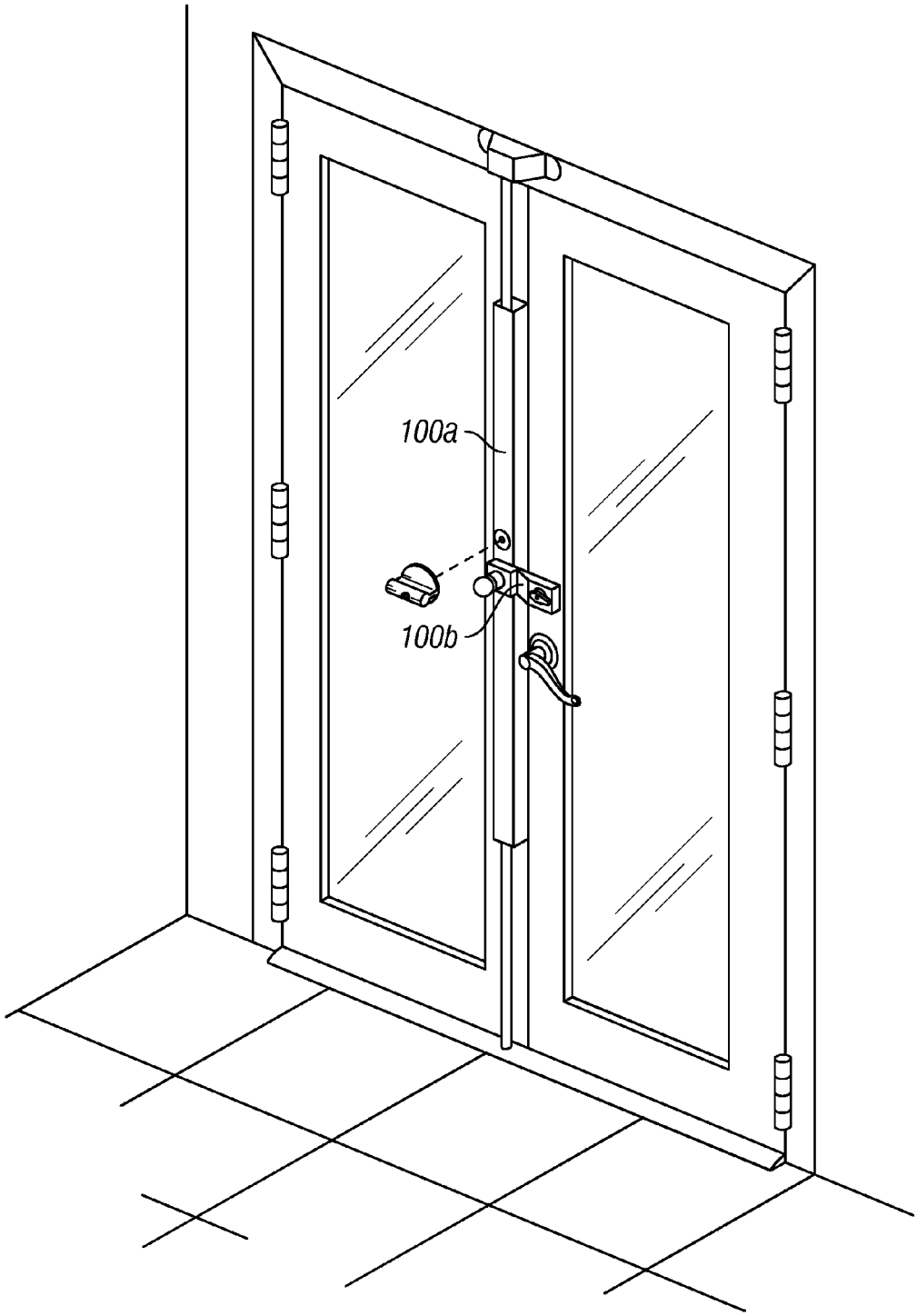
FIGS. 31 and 32 illustrate improved security systems for doubleglass doors.
Figure 32:
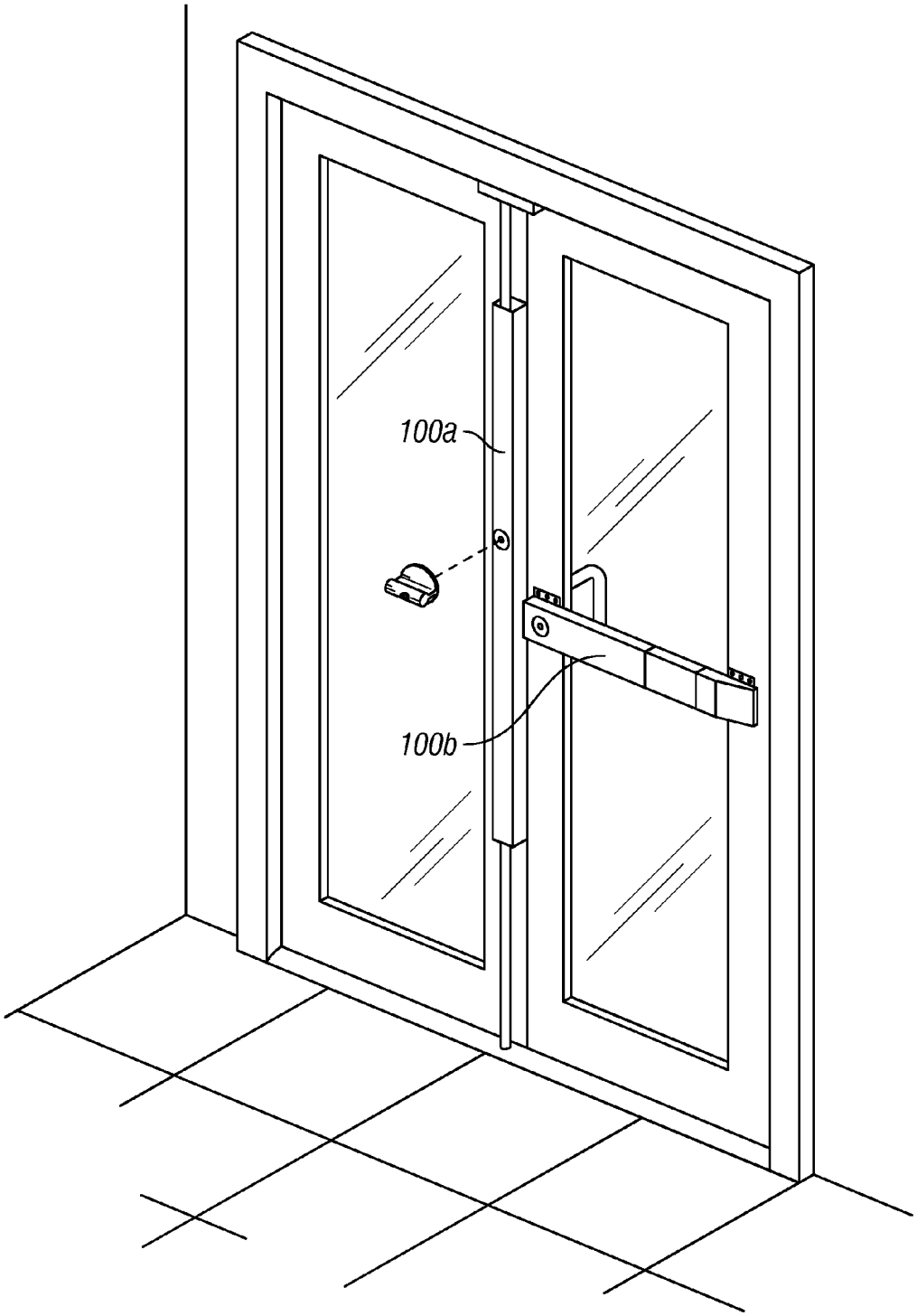

FIGS. 31 and 32 illustrate the use of an improved system100a such as described above for FIG. 28 and an improved system 100*b* such as described above for FIGS. 19*a* and 19*b* to secure double, swinging glass doors. As an alternate to the system 100*b*, any of the other systems 100 may be utilized as desired. This FIG. illustrates the ability to combine multiple of the systems and features described herein to achieve the desired security for a variety of entrance barriers.

Figure 33:
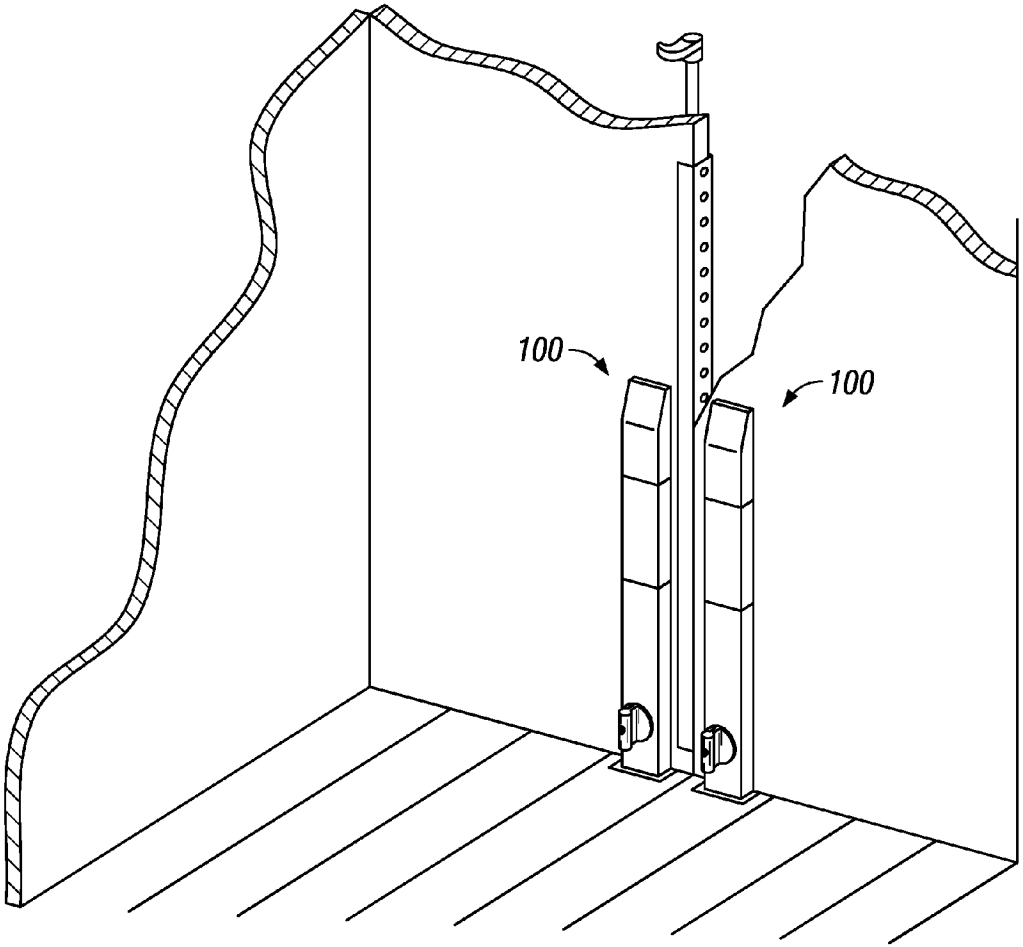
FIGS. 33 and 34 illustrate an improved safety system in use on the rear doors of a conventional tractor-trailer.
Figure 34:
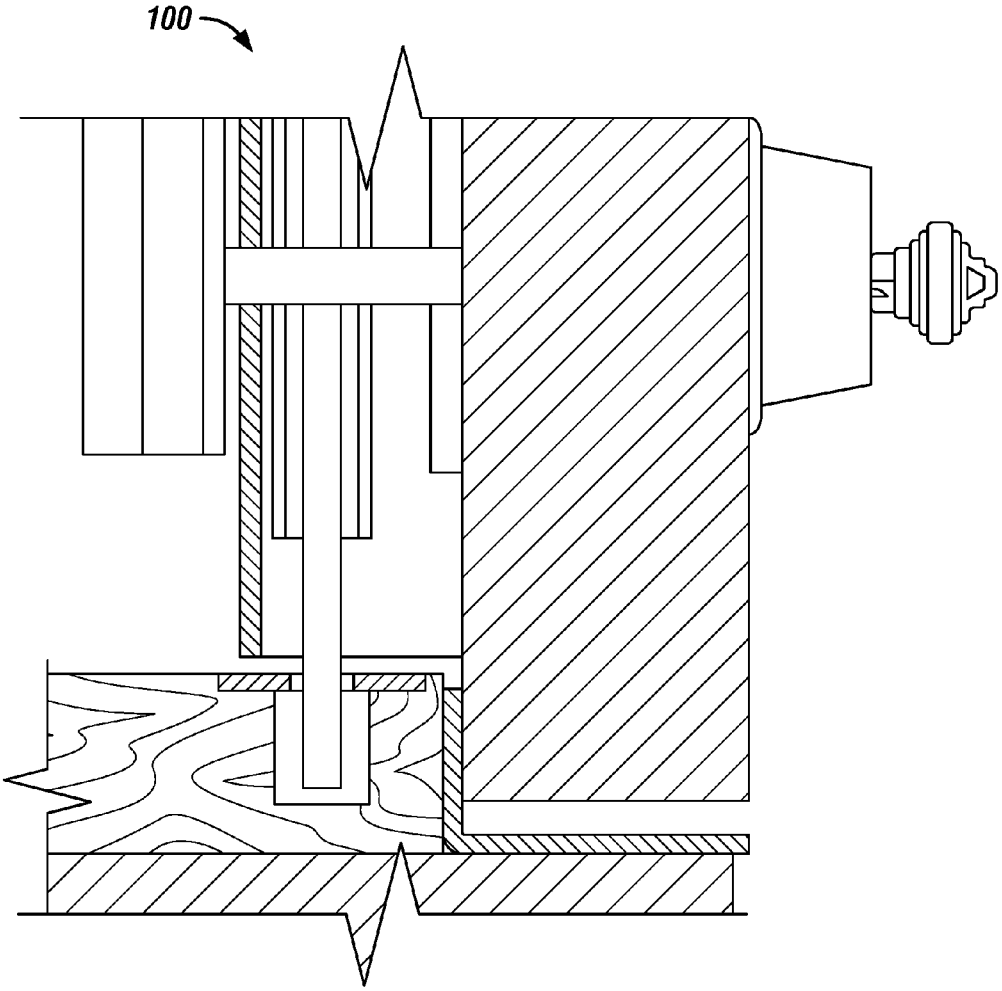

FIGS. 33 and 34 illustrate the use of an improved system 100 such as described above for FIG. 18, to secure the doors on a tractor-trailer rig. The functionality and structures of the system 100 disclosed in FIGS. 33 and 34 are similar to the functionality and structures of systems 100 previously discussed.

Figure 35A:
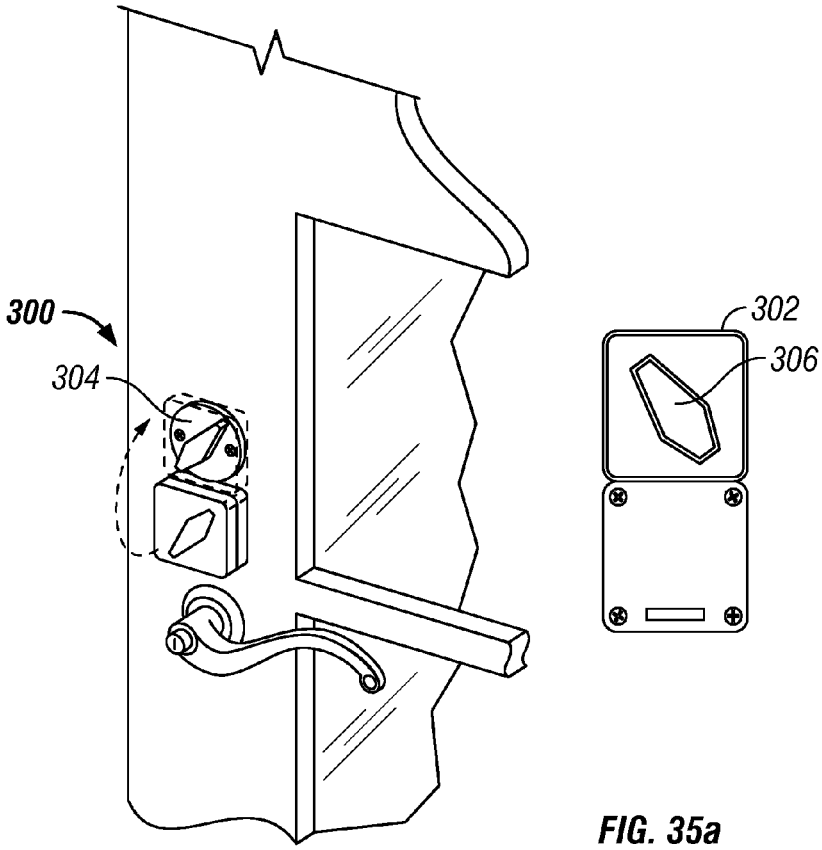
FIGS. 35*a*, 35*b*, 36*a* and 36*b* illustrate an additional security feature for entrance barriers comprising a manual lock-out for knob locks.
Figure 35B:
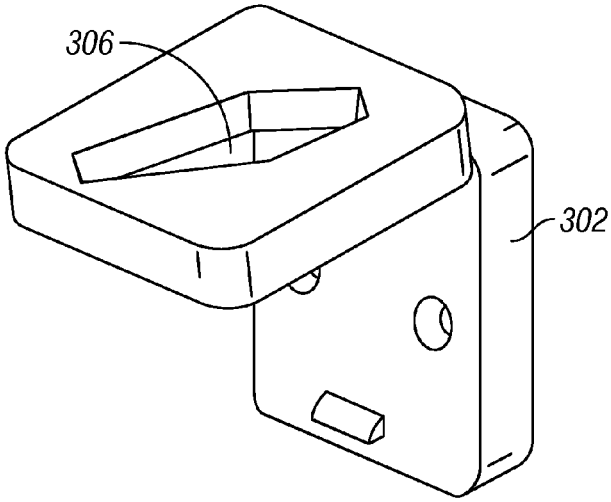

FIGS. 35*a* and 35*b* illustrate and improved security system 300 for "Hotel" type dead bolt locks wherein the exterior of the lock is keyed, but the interior has a knob. To prevent the type of lock from opened from the exterior with a key; a handle-restricting device 302 may be used to prevent the handle from turning and the bolt from retracting. FIG. 35*a* illustrates a hinged device 302 that maybe mounted to the door above or below the knob 304. The device 302 is adapted to snap into the unlocked condition as shown on the left in FIG. 35*a*. When it is desired to lock the Hotel lock, a portion 306 of the device 302 is rotated such that the knob 304 is received in a receptacle 306. Once the knob is received in the receptacle 306, the knob may not be turn or the lock opened from the outside. An alternate embodiment is illustrated in FIGS. 36*a* and 36*b*.

Figure 36A:
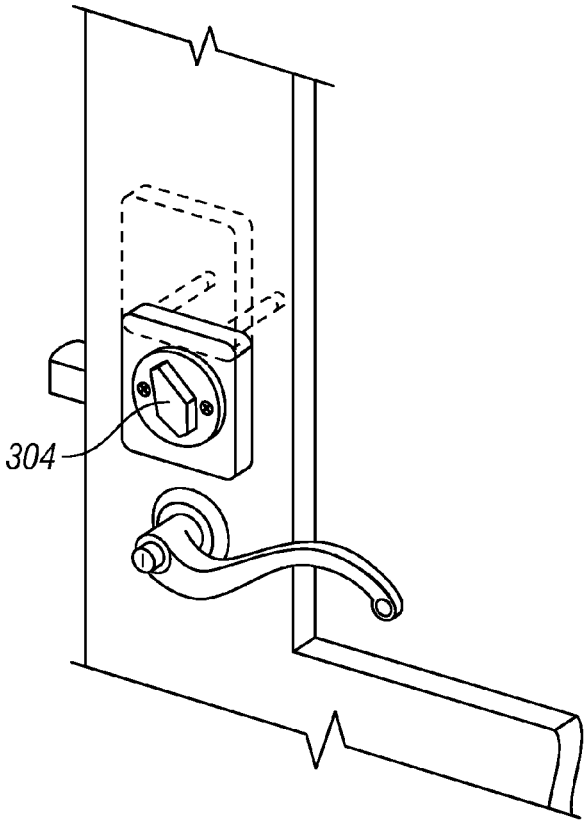
Figure 36B:
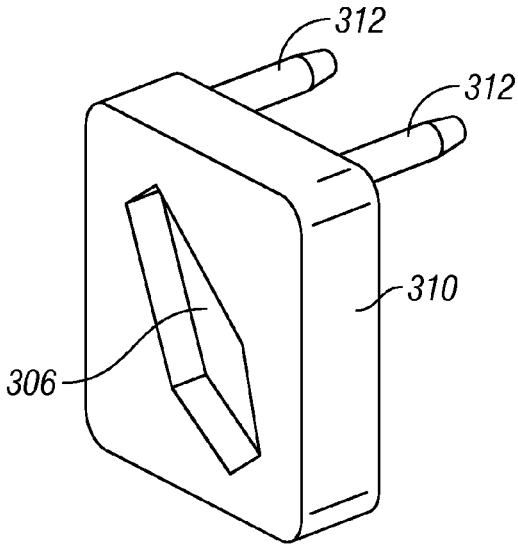

In FIGS. 36*a* and 36*b*, the system 300 comprises a single portion 310 having one or more pins 312. The pins are adapted to mate with corresponding holes in the door such that in one position the system 300 prevents the lock from being opened from the exterior and in another position (shown by dashed lines) the system does not interfere with operation of the lock.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intends to protect all such modifications and improvements to the full extent that such falls within the scope or range of equivalent of the following claims.

What is claimed is:

1. A security system for a hinged barrier, in which the barrier defines an interior space on one side of the barrier and an exterior space on an opposing side of the barrier and a hinged portion on one side edge, the system comprising:

a first lock assembly located on the exterior space side of the barrier and comprising a deadbolt and a first actuation mechanism operable from at least the exterior space and configured to move the deadbolt from a first position to a second locking position extending away from the hinged portion;

a second lock assembly located on the interior space side of the barrier, the second lock assembly comprising a member extendable from a first position to a second locking position extending away from the hinged portion and substantially parallel to the second locking position of the deadbolt, a second actuation mechanism operable from the interior space and configured to extend the member from the first position to the second locking position and cooperating with the first lock assembly such that actuation of the first lock assembly from the exterior space extends the member from the first position to the second locking position;

a receptacle having a first portion for receiving the deadbolt in the locked position and the receptacle having a second portion for receiving the member in the locked position, to thereby lock the barrier when the deadbolt and member are extended into the receptacle; and an override mechanism having engaged and disengaged conditions, operable only from the interior space, and operable separately from the first and second actuation mechanisms, the override mechanism comprising at least two components that matingly engage to prevent the member from being retracted from the locked position and the barrier from being opened when the override mechanism is engaged.

2. The system of claim 1, wherein the barrier is a door.

3. The system of claim 1, wherein the barrier is a residential door.

4. The system of claim 1, wherein the member is a telescoping tubular structure.

5. The system of claim 1, wherein the member is a high strength plate.

6. The system of claim 1, wherein the second lock assembly comprises a rack and gear assembly.

7. The system of claim 1, wherein the first lock assembly provides keyed actuation of the second lock assembly from an exterior surface of the barrier.

8. The system of claim 1, wherein the override mechanism comprises a pin, and a hole in the member.

9. The system of claim 1, wherein the override mechanism is selected from the group consisting of: a pin, and a hole in the member; a card reader; a biometric scanner; a lock; and any combination of the foregoing.

10. The system of claim 1, wherein the second lock assembly comprises a handle to effect manual actuation of the member.

11. The system of claim 1, further comprising a motor to automatically actuate the member between its first and second positions.

12. The system of claim 2, wherein the member spans more than half of the door width.

13. The system of claim 1, wherein the override mechanism is associated with the receptacle.

14. The system of claim 1, wherein the system is an add-on to an existing barrier.

15. The system of claim 1, further comprising an aesthetic cover assembly for the system.

16. The system of claim 13, wherein the override mechanism comprises a pin associated with the receptacle and a hole in the member.

* * * * *